US010272289B2

(12) United States Patent
Kamins

(10) Patent No.: US 10,272,289 B2
(45) Date of Patent: Apr. 30, 2019

(54) LOWER EXTREMITY RECEIVING DEVICE FOR PROVIDING ENHANCED LEG MOBILITY DURING LOWER BODY EXERCISE

(71) Applicant: Paul Kamins, Lancaster, NH (US)

(72) Inventor: Paul Kamins, Lancaster, NH (US)

( * ) Notice: Subject to any disclaimer, the term of this patent is extended or adjusted under 35 U.S.C. 154(b) by 0 days.

(21) Appl. No.: 15/183,605

(22) Filed: Jun. 15, 2016

(65) Prior Publication Data

US 2016/0296787 A1 Oct. 13, 2016

Related U.S. Application Data

(63) Continuation-in-part of application No. 14/876,811, filed on Oct. 6, 2015, now abandoned, and a (Continued)

(51) Int. Cl.
*A63B 21/00* (2006.01)
*A63B 23/04* (2006.01)
(Continued)

(52) U.S. Cl.
CPC ..... *A63B 23/04* (2013.01); *A63B 21/0442* (2013.01); *A63B 21/0552* (2013.01); *A63B 21/4013* (2015.10); *A63B 21/4015* (2015.10); *A63B 21/4043* (2015.10); *A63B 23/03508* (2013.01); *A63B 23/0482* (2013.01); *A63B 21/00069* (2013.01); *A63B 21/0557* (2013.01); *A63B 21/0628* (2015.10);
(Continued)

(58) Field of Classification Search
CPC ..... A61F 5/0111; A63B 23/08; A63B 23/085; A63B 23/10; A63B 23/04; A63B 23/0482; A63B 23/0488; A63B 23/4013; A63B 23/4015; A63B 21/40; A63B 21/4001; A63B 21/4011; A63B 21/4013; A63B 21/4015
USPC ..... 602/28
See application file for complete search history.

(56) References Cited

U.S. PATENT DOCUMENTS 3,976,059 A * 8/1976 Lonardo ..... A61F 5/0111 602/28
4,205,839 A * 6/1980 Best ..... A63B 21/154 294/169
(Continued)

*Primary Examiner* — Nyca T Nguyen
(74) *Attorney, Agent, or Firm* — Joseph Aufiero

(57) ABSTRACT

A lower extremity receiving device is disclosed, which facilitates enhanced gluteal muscle engagement, body stability, and range of motion. The device includes a self-standing sling that can stand upright and ready to receive a user's lower extremity and enable them to commence any combination of hip extension or hip abduction with proper form upon inserting their foot, the sling including a heel socket that surrounds and facilitates rotational movement of the user's heel during the applicable hip extension exercise, and a resistance harness connected to the sling and capable of engaging a resistance-transmitting line for exercise, the harness having a clearance space for providing clearance for a user's foot as they alternately insert or remove their foot. This functional framework of elements enables a user to perform full range of combination of hip extension and hip abduction under resistance, via hands-free insertion of either foot into the sling.

16 Claims, 21 Drawing Sheets

Related U.S. Application Data continuation-in-part of application No. 14/876,810, filed on Oct. 6, 2015, now abandoned.

(60) Provisional application No. 62/060,556, filed on Oct. 6, 2014.

(51) Int. Cl.

| | |
|---|---|
| ***A63B 21/062*** | (2006.01) |
| ***A63B 23/035*** | (2006.01) |
| ***A63B 21/04*** | (2006.01) |
| ***A63B 21/16*** | (2006.01) |
| ***A63B 21/055*** | (2006.01) |

(52) U.S. Cl.

CPC ..... *A63B 21/154* (2013.01); *A63B 21/169* (2015.10); *A63B 21/4039* (2015.10); *A63B 23/0488* (2013.01); *A63B 2208/0204* (2013.01); *A63B 2208/0209* (2013.01); *A63B 2209/10* (2013.01); *A63B 2210/50* (2013.01)

(56) References Cited

U.S. PATENT DOCUMENTS 4,325,548 A * 4/1982 Piccini ..... A63B 21/0552 482/129
4,869,499 A * 9/1989 Schiraldo ..... A61H 1/0266 482/124
5,231,775 A * 8/1993 Trent, Jr. ..... A63B 27/02 182/134
5,253,693 A * 10/1993 Marlatt ..... A62C 2/242 160/315
D373,803 S 9/1996 Winans
5,582,579 A * 12/1996 Chism ..... A61H 1/0259 482/79
5,695,437 A * 12/1997 Olschansky ..... A63B 21/0552 482/122
5,782,727 A * 7/1998 Pierce ..... A63B 21/0552 482/121
D674,448 S 1/2013 Puig
8,382,694 B2 * 2/2013 Wenger ..... A61F 5/0111 602/23
2006/0063651 A1 * 3/2006 Sload ..... A63B 21/0004 482/124
2011/0034307 A1 * 2/2011 Eddy ..... A63B 21/00 482/131
2013/0338558 A1 * 12/2013 Chen ..... A61F 5/0111 602/27
2015/0031511 A1 * 1/2015 Matthews ..... A63B 21/0557 482/124
2015/0157893 A1 * 6/2015 Canevari ..... A63B 21/4035 482/129
2016/0256732 A1 * 9/2016 Kasner ..... A63B 21/4015

* cited by examiner

PRIOR ART

PRIOR ART

LOWER EXTREMITY RECEIVING DEVICE FOR PROVIDING ENHANCED LEG MOBILITY DURING LOWER BODY EXERCISE

CROSS-REFERENCE TO RELATED APPLICATIONS

This present application is a continuation-in-part of applicant's co-pending application Ser. No. 14/876,810, filed Oct. 6, 2015 and entitled "Stowable Lower Body Fitness Apparatus Providing Enhanced Muscle Engagement, Body Stability and Range of Motion," which itself claims the benefit of Provisional Application 62/060,556, filed Oct. 6, 2014—and the disclosure of application Ser. No. 14/876,810 is also hereby incorporated by reference in its entirety into the present application. The present application is also a continuation-in-part of applicant's co-pending application Ser. No. 14/876,811, filed Oct. 6, 2015 and entitled "Lower Extremity Receiving Device for Providing Enhanced Leg Mobility During Lower Body Exercise," which itself also claims the benefit of Provisional Application 62/060,556, filed Oct. 6, 2014—and the disclosure of application Ser. No. 14/876,811 is also hereby incorporated by reference in its entirety into the present application.

FIELD

The invention relates generally to fitness equipment, and more particularly to devices for lower body exercise.

BACKGROUND

In addition to being an integral part of an individual's overall physical fitness, toned and shapely buttocks and legs have also become desirable due to their perceived physical attractiveness. As a result, the market for lower body exercise machines and devices has grown in recent years, especially among women. Many such machines and devices are known in the art.

One approach to exercising the lower body involves use of a resistance-transmitting line, such as a weight machine line or an elastic resistance line, coupled at a pullable end with a user's leg. Exercise with a resistance-transmitting line can deliver continuous resistance during extension and/or abduction of the user's hip, which in turn can work the gluteal muscles and thereby enhance sculpting of the buttocks.

However, while use of a resistance-transmitting line is an effective general method of exercise, its use for buttocks exercise poses problems. In particular, the means of coupling the line with the exercising leg can create difficulties for a user wishing to engage all of their gluteal muscles conveniently and efficiently. Attempts to do so on their part can lead to frustration and distraction, premature muscle fatigue, and/or unbalanced muscle development.

SUMMARY

Various embodiments of an improved lower extremity receiving device are disclosed, which provide enhanced leg mobility during lower body exercise. Unlike other known mechanisms for coupling a resistance-transmitting line to a user's leg, the present invention can wrap securely around a portion of a user's lower extremity for hip extension and/or abduction exercise, but can also be engaged and disengaged without any manual effort.

This enables a user to alternate their exercising leg after each set of exercises performed. For example, after performing a set of hip extensions with one leg, the user can easily disengage the line from that leg and engage for a set of hip extensions with the other leg. By alternating legs during extension before performing hip abduction (and/or vice versa), the user can continue their exercise routine while still giving their opposite side gluteal muscles time to rest.

This functionality is facilitated by a self-standing sling that is capable of securing the user's posterior leg during hip extension, and the user's lateral foot during hip abduction. The sling's supportive scaffold is also rigid and spacious enough to alternatively receive and release the user's foot without any need for manual engagement, yet flexible and contoured enough to wrap securely around the user's foot and/or leg during actual leg motion.

The sling further includes a curved band to receive the user's posterior leg for hip extension, and their lateral foot for hip abduction; and a heel socket to facilitate rotational movement of the heel during extension. A resistance harness couples the sling with the resistance-transmitting line to facilitate delivery of force of resistance during exercise, with a clearance space for the user's front foot to be alternately inserted into, and withdrawn from, the sling without manual effort.

These elements combine synergistically to enhance the user's leg mobility, enabling them to exercise with maximum efficiency and convenience. Without having to manually engage or disengage the device when switching their exercising leg, the user is free to focus on their form throughout their entire exercise routine. Indeed, this design actually compels the user to assume the best form, for achieving the best results.

In contrast to other devices that couple a user's exercising leg with a resistance-transmitting line, embodiments disclosed herein enable a user to fully engage the device simply by stepping into the device and positioning their foot ready for exercise. As the user then applies the initial motion for their desired exercise, the device naturally wraps securely around the user's leg and/or foot by its own inherent design, and thereby induces ideal exercise performance.

In one general aspect, a lower extremity receiving device for hands-free lower body exercise is claimed, the device comprising: a self-standing sling, the sling configured to wrap securely around a portion of a user's lower extremity during exercise, the sling including a supportive scaffold adapted to provide structural support to the sling to help the sling stand up and open, the scaffold enabling the user to alternately engage and disengage the sling for exercise with either leg without any manual effort, the scaffold having an upper band that is adapted to receive and contain the user's posterior leg above their heel apex for substantial hip extension when upright, and to receive and contain the user's lateral foot for substantial hip abduction when side-lying, and a heel socket framed by the scaffold, the socket being adapted to surround and facilitate rotational movement of the user's heel throughout substantial hip extension, and to deform around the user's lateral foot during substantial hip abduction; and a resistance harness connected to the sling, the harness being adapted to engage a pullable portion of a resistance-transmitting line, thereby coupling the sling with the line to facilitate delivery of force of resistance from the line to the sling during exercise, the harness being configured to provide a clearance space positioned substantially opposite the heel socket relative to the sling, the space providing clearance for the user's foot as the user alternately inserts their foot into and removes their foot from the upright or side-lying sling, the lower extremity receiving device thereby enabling the user to perform full range of any combination of hip extension and hip abduction under line resistance via hands-free insertion of either foot into the sling.

In some embodiments, the scaffold includes a spring function that induces the sling to expand and assume a semi-rigid open state for receiving the user's foot when not in use, but also allows the sling to wrap securely around the portion of the user's lower extremity during use. In some embodiments, the scaffold includes a plurality of straps that are joined to provide sufficient structural support to the sling, at least one of the straps serving as the upper band. In some embodiments, the scaffold includes sidewalls. In some embodiments, the sling also includes a cushioning material that is attached to the supportive scaffold.

In some embodiments, the sling includes a lower heel stay that is adapted to receive and contain the user's foot during apex of a hip extension repetition, the lower heel stay also providing a bottom border to the socket. In some of those embodiments, the lower heel stay is either a lower band included in the scaffold, or a heel strap connected to the scaffold. In some embodiments with a lower heel stay, the lower heel stay is adjustable and thus capable of also adjusting a size of the socket. In some embodiments with a lower heel stay, the upper band and the lower heel stay respectively lie in substantially parallel planes.

In some embodiments, the socket lies substantially in a vertical plane. In some embodiments, the socket and the upper band are shaped and positioned relative to each other as to substantially conform laterally about a common columned surface. In some embodiments, the harness connects two front ends of the sling to form the sling into a closed ring.

In some embodiments, the harness is coextensive with the upper band. In some embodiments, the harness includes at least one loop through which a belt can pass. In some embodiments, the harness includes a belt adapted to connect to the resistance-transmitting line. In some embodiments, the harness includes at least one loop through which an elastic resistance line can pass. In some embodiments, the harness is aligned substantially parallel to a bottom edge of the sling. In some embodiments, the harness with an top edge that is aligned substantially at an acute angle relative to a bottom edge of the sling, the angle having a vertex located opposite the socket relative to the harness.

In another general aspect, a lower extremity receiving device for hands-free lower body exercise is claimed, the device comprising: a self-standing sling, the sling configured to wrap securely around a portion of a user's lower extremity during exercise, the sling including a supportive scaffold adapted to provide structural support to the sling to help the sling stand up and open, the scaffold enabling the user to alternately engage and disengage the sling for exercise with either leg without any manual effort, the scaffold having an upper band that is adapted to receive and contain the user's posterior leg above their heel apex for substantial hip extension when upright, and to receive and contain the user's lateral foot for substantial hip abduction when side-lying, and a heel socket framed by the scaffold, the socket being adapted to surround and facilitate rotational movement of the user's heel throughout substantial hip extension, and to deform around the user's lateral foot during substantial hip abduction; and a resistance harness connected to the sling, the harness being adapted to engage a pullable portion of a weight machine line, thereby coupling the sling with the line to facilitate delivery of force of resistance from the line to the sling during exercise, the harness being configured to provide a clearance space positioned substantially opposite the heel socket relative to the sling, the space providing clearance for the user's foot as the user alternately inserts their foot into and removes their foot from the upright or side-lying sling, the lower extremity receiving device thereby enabling the user to perform full range of any combination of hip extension and hip abduction under line resistance via hands-free insertion of either foot into the sling.

In still another general aspect, the a lower extremity receiving device for hands-free lower body exercise is claimed, the device comprising: a self-standing sling, the sling configured to wrap securely around a portion of a user's lower extremity during exercise, the sling including a supportive scaffold adapted to provide structural support to the sling to help the sling stand up and open, the scaffold enabling the user to alternately engage and disengage the sling for exercise with either leg without any manual effort, the scaffold having an upper band that is adapted to receive and contain the user's posterior leg above their heel apex for substantial hip extension when upright, and to receive and contain the user's lateral foot for substantial hip abduction when side-lying, and a heel socket framed by the scaffold, the socket being adapted to surround and facilitate rotational movement of the user's heel throughout substantial hip extension, and to deform around the user's lateral foot during substantial hip abduction; and a resistance harness connected to the sling, the harness being adapted to engage a pullable portion of an elastic resistance line, thereby coupling the sling with the line to facilitate delivery of force of resistance from the line to the sling during exercise, the harness being configured to provide a clearance space positioned substantially opposite the heel socket relative to the sling, the space providing clearance for the user's foot as the user alternately inserts their foot into and removes their foot from the upright or side-lying sling, the lower extremity receiving device thereby enabling the user to perform full range of any combination of hip extension and hip abduction under line resistance via hands-free insertion of either foot into the sling.

BRIEF DESCRIPTION OF DRAWINGS

The invention will be more fully understood by reference to the detailed description, in conjunction with the following figures, wherein:

FIG. 1 is a front oblique view of a prior art embodiment of an ankle strap designed to be manually fastened around a user's ankle;

FIG. 2 is a front oblique view of a prior art embodiment of a configuration of straps designed to be manually applied to a user's foot and/or ankle; and FIG. 3 is a front oblique view of another prior art embodiment of a configuration of straps designed to be manually applied to a user's foot/ankle;

FIGS. 4-5 teach a basic functional framework of the invention, specifically:

FIG. 4 is an unembellished illustrative embodiment of the invention;

FIGS. 7-9 illustrate some key functionalities of the invention, specifically:

FIG. 8 is a rear oblique view of an embodiment of the invention wrapped around a user's posterior leg and foot during hip extension exercise; and FIG. 9 is a rear oblique view of the embodiment of FIG. 8 wrapped around a user's lateral foot during hip abduction exercise;

FIGS. 10-15 disclose possible embodiments of the invention, specifically:

FIG. 10 is an illustration of structural support arrangements for various possible embodiments of a sling, in accordance with the invention;

FIG. 11 is an illustration of design components for various possible embodiments of a socket, scaffold and harness in accordance with the invention;

FIG. 13 is a rear oblique view of another embodiment of the invention that also includes a lower band;

FIG. 14 is a front oblique view of the embodiment of FIG. 8 which includes a heel strap and a channel housing a belt; and FIG. 15 is a rear oblique view of another embodiment of the invention that includes a heel strap and a channel housing an elastic resistance line.

FIG. 16 is an oblique perspective view of the embodiment of FIG. 15 attached to the foot of a wall via a dedicated wall mount configuration;

FIG. 17 is a top view of the embodiment of FIG. 15 being used in conjunction with the wall's surface to perform various hip exercises;

FIG. 18 is a top view of the embodiment of FIG. 12 being used with a lower body fitness apparatus to perform various hip exercises; and FIG. 19 is a side oblique view of the embodiment of FIG. 15 set up for use with a portable platform anchor.

DETAILED DESCRIPTION

The gluteal muscles are often considered the powerhouse of the body and an essential part of the body's "core," and as such, they are of central focus in strength training and physical fitness. Toning of the gluteal muscles also holds substantial aesthetic appeal, particularly for female physiques. However, traditional exercises for targeting the gluteal muscles require weightlifting in a variety of difficult and/or uncomfortable postures.

Given the growing desire among women to build their gluteal muscles, the demand for more ergonomic exercise equipment that can effectively target this area of the body has increased substantially. While some resistance-transmitting line modalities seemingly offer comparatively convenient gluteal workout routines, their perceived convenience actually comes at the expense of optimal gluteal muscle engagement.

This detailed description corresponds with the accompanying drawings. First, known devices from the prior art used for gluteal muscle exercise are surveyed. The main features of these devices are summarized, along with their benefits and failings. Following this prior art survey, the current inventive concept is explained by reference to a functional framework, and various possible embodiments and adaptations.

Relevant Prior Art Designs

Figure 1:
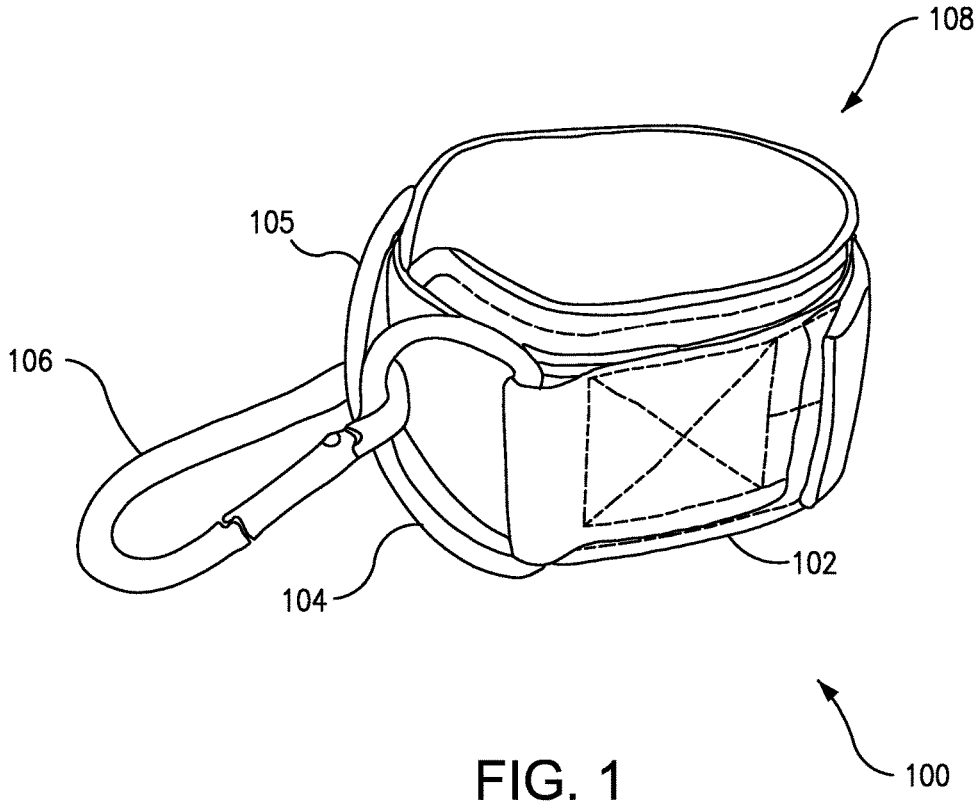
FIGS. 1-3 introduce prior art designs relevant to the invention, specifically.
Figure 2:
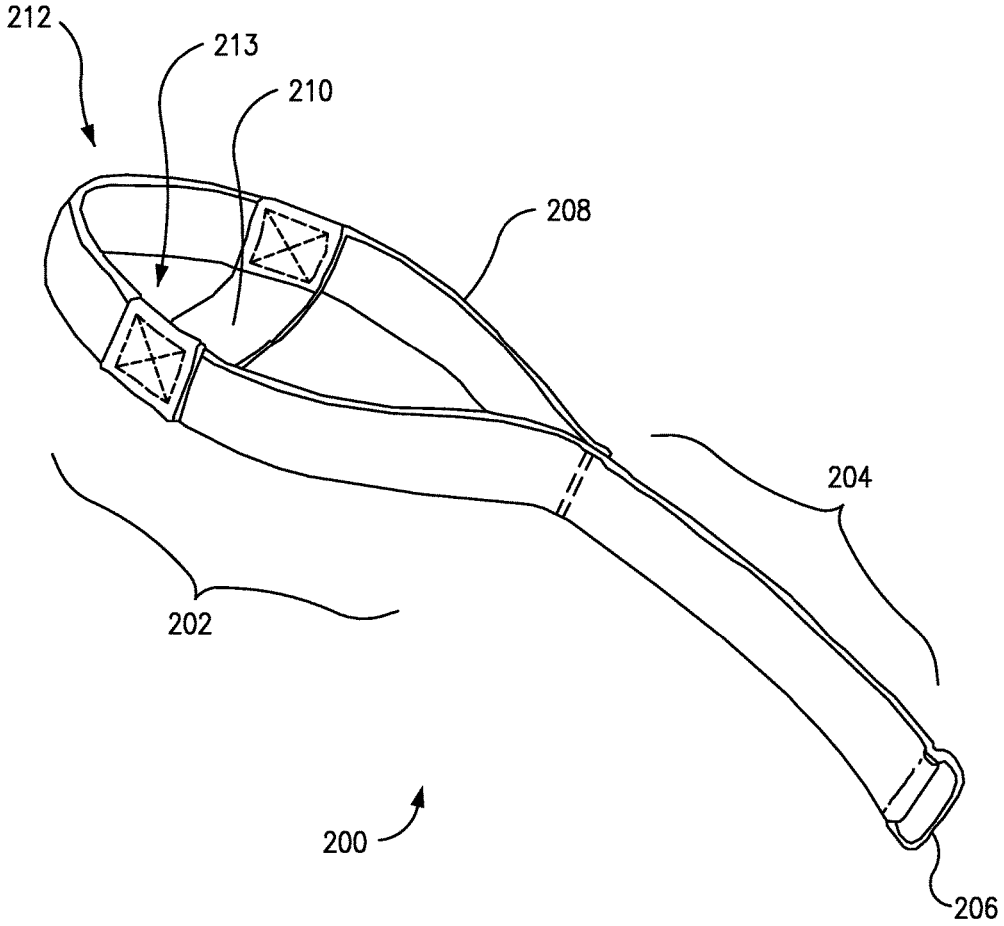
Figure 3:
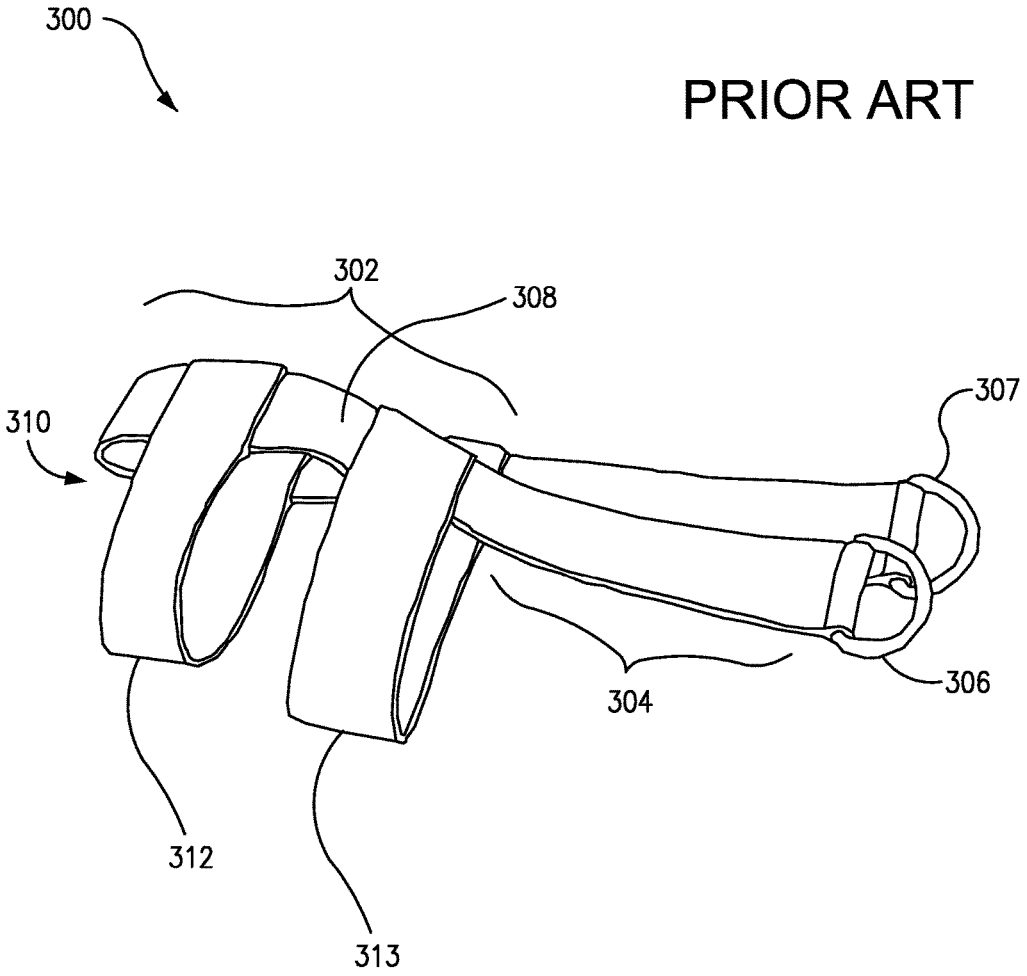

FIGS. 1, 2 and 3 introduce prior art designs relevant to the invention, specifically: FIG. 1 is a front oblique view of a prior art embodiment of an ankle strap designed to be manually fastened around a user's ankle; FIG. 2 is a front oblique view of a prior art embodiment of a configuration of straps designed to be manually applied to a user's foot and/or ankle; and FIG. 3 is a front oblique view of another prior art embodiment of a configuration of straps designed to be manually applied to a user's foot/ankle.

1

FIG. 1 is a front oblique view of a prior art embodiment 100 of an ankle strap designed to be manually fastened around a user's ankle. The device shown includes a band 102 adapted to wrap around a user's ankle, a pair of rings 104, 105, one attached to either end of the band, and a locking loop 106 (e.g., with a spring-loaded gate or karabiner) that holds the D-rings together, and which can connect the ankle strap 100 to a resistance-transmitting line.

The ankle strap 100 is adjustable in the loop that it makes. The band 102 can be adjusted to fit snugly around a given user's posterior leg, at or adjacent to the ankle area. While the embodiment 100 shown makes use of a hook-and-loop system (e.g., Velcro), other adjustment means can be contemplated, such as a belt for example. The rings 104, 105 shown in FIG. 1 are D-rings. Their semicircular shape allows the locking loop 106 to slide up and down their extent, enabling a user to exercise their leg in a variety of ways, under resistance.

These functionalities make the ankle strap 100 considerably useful for hip extension and/or hip abduction exercises, which strengthen the gluteal muscles. However, several limitations prevent optimal gluteal exercise. Although it is advantageous to switch legs frequently during exercise, this strap 100 must be meticulously applied manually to each leg, either by using two straps, applying one to each legs and switching the line from one leg to another, or switching a single strap from one leg to the next each time the user switches sets.

Furthermore, if the strap 100 succumbs to the force vector of the resistance-transmitting line, it can slip up the leg and disrupt exercise even further. This is due to the fact that the ankle strap is more secure when the force vector is predominantly oriented radially outward, but less secure when the force vector is largely parallel to the leg. Finally, the ankle strap requires that the force of resistance be applied at the position of the heel, thereby shortening the lever arm from the hip and rendering exercise less efficient.

2

FIG. 2 is a front oblique view of a prior art embodiment 200 of a configuration of straps designed to be manually applied to a user's foot and/or ankle. The device shown 200 includes a loop 202 adapted to receive a user's foot, a harness band 204 connected to the loop 202 and a ring 206 attached to a proximal end of the harness band 204. The device 200 can be connected to a resistance-transmitting line via the ring 206, thereby delivering force of resistance to the loop 202 and thus to the user's leg.

The loop 202 is formed by a loop band 208 fashioned into a closed loop, and a cross band 210 attached to the loop band 208 and crossing the width of the loop 202. The cross band 210 positioned at roughly one-third the length of the loop 202 as measured from the distal apex 212 of the loop 202. The space bounded by the cross band 210 and the distal portion of the loop band 208 can function as a heel socket 213 in which the user can place their heel.

This prior art embodiment 200 offers some unique advantages to a user performing hip extension. It is considerably easier to apply for exercise than the ankle strap 100 of FIG. 1, and it also offers greater resistance because of its position in relation to the user's exercising leg. This device 200 sits around the lower portion of the user's ankle, rather than above the ankle as in the ankle strap of FIG. 1. Therefore, this device provides a longer lever arm, applying greater resistance and even greater stability of motion, during exercise.

Nonetheless, a user of this set of straps 200 would still encounter considerable impediments to optimal gluteal exercise. This device 200 still requires manual application to the foot, to ensure that the distal end of the loop band 210 runs around the proper area of the heel, that the distal loop apex 212 is positioned high enough against the back of the heel, and that the heel itself fits securely inside the heel socket 213 for proper exercise stability.

However, the greatest impediment to optimal gluteal exercise presented by this set of straps 200 is its inability to facilitate hip abduction exercise under resistance. Hip abduction is achieved by moving the leg laterally outward and upward. The set of straps shown here 200 cannot be fit to an exercising leg to enable hip abduction, as the cross band 210 would interfere. Even if abduction were possible, the distance between the distal apex 212 and the ring 206 would shorten one's range of motion so much as to render abduction ineffective for gluteal exercise.

Simple adaptation of the straps of this device 200 would not solve the basic problem. For example, if the cross band 210 were redesigned, repositioned or altogether removed, the device would no longer enable effective hip extension exercise. The cross band 210 with the design parameters shown is required to facilitate full range of motion for hip extension exercise, yet those very same design parameters prevent even basic range of motion for hip abduction exercise. The problem is the basic framework of the design itself.

3

FIG. 3 is a front oblique view of another prior art embodiment 300 of another configuration of straps designed to be manually applied to a user's foot/ankle. This embodiment 300 includes a foot receiving portion 302 and a harness portion 304 consisting of a pair of strap portions extending beyond the foot receiving portion 302, each strap including a ring 306, 307 at their respective proximal ends, for connecting to a resistance-transmitting line.

The foot receiving portion 302 includes a lateral band 308 which turns at a distal apex 310, and two straps 312, 313 connected to the lateral band 308 at two points equidistant and on opposite sides to the distal apex 310, and looping downwards to receive a portion of a user's foot. In this embodiment, a user's upper heel can be wrapped and contained by the distal portion of the lateral band 308, while the two straps 312, 313 contain the bottom of the foot, during hip extension.

While this device 300 offers a unique experience as compared with the devices of FIGS. 1 and 2, when it comes to optimal gluteal exercise, this device 300 still suffers from the same drawbacks as they do. This device 300 still requires considerable manual application for use with each exercising leg. Finally, this device is no less clumsy for hip abduction, than the device 200 of FIG. 2. Ultimately, gluteal exercise is served only sub-optimally by the ankle band 100 of FIG. 1, and the straps 200, 300 of FIGS. 2 and 3 are woefully inadequate.

Basic Functional Framework

Figure 4:
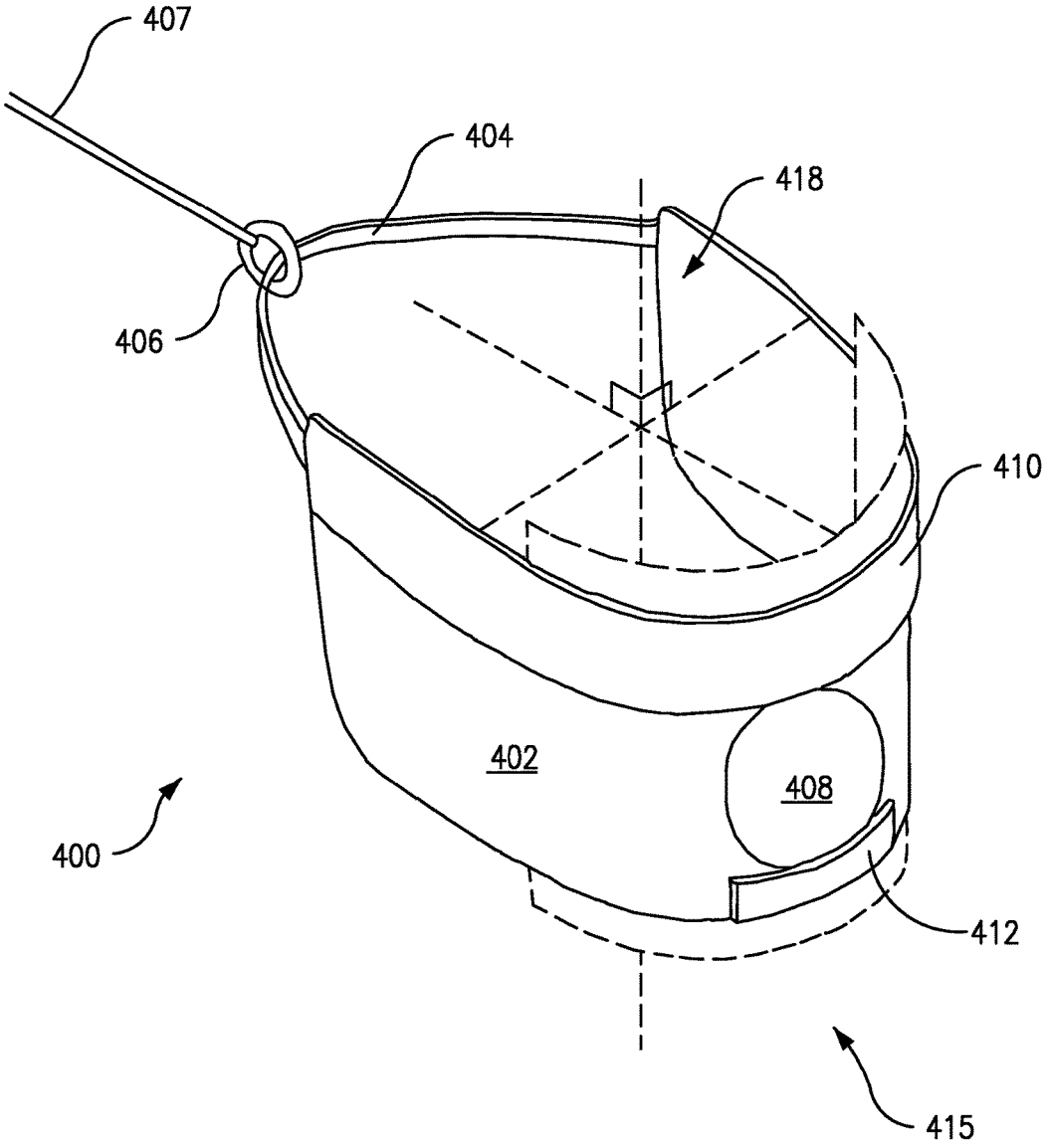
Figure 5A:
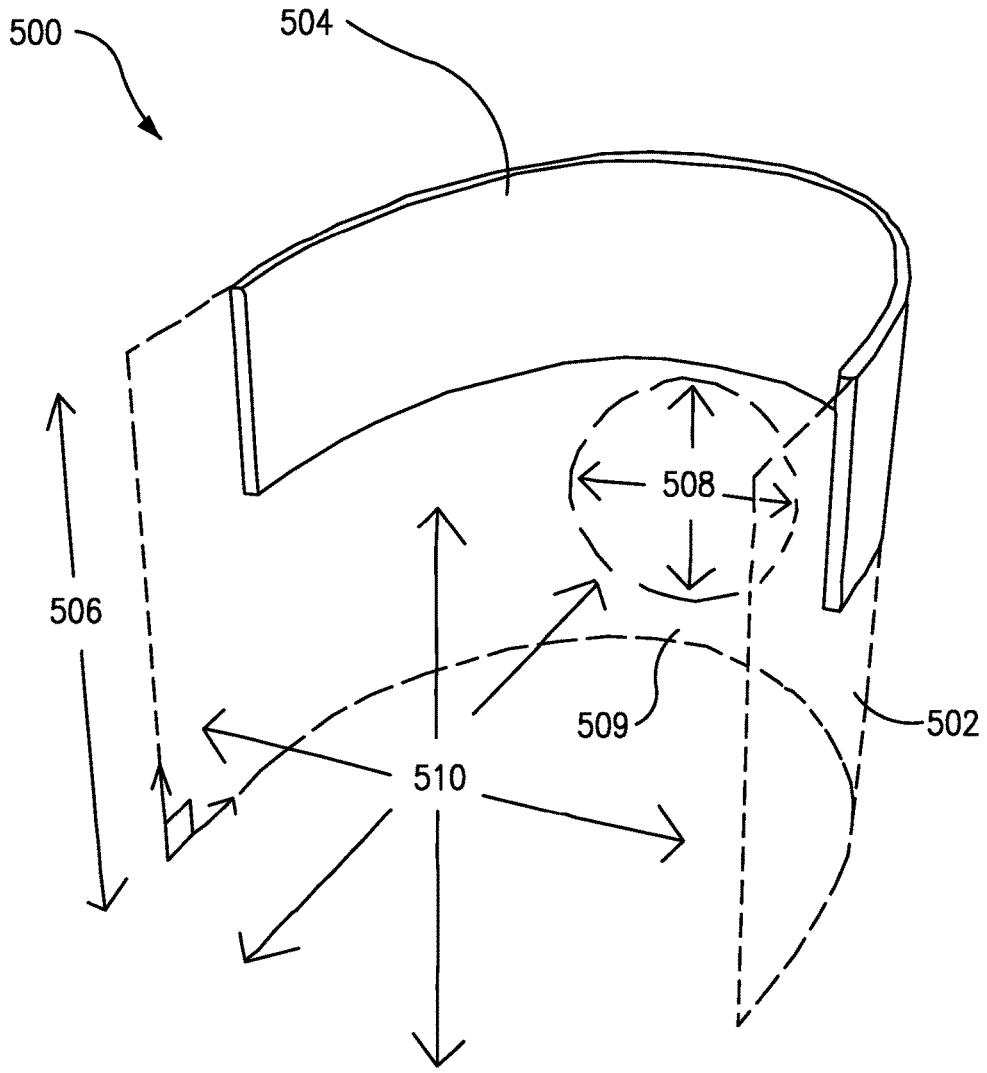
FIG. 5A is a front oblique view of a functional framework of the illustrative embodiment and various other possible embodiments of the invention.
Figure 5B:
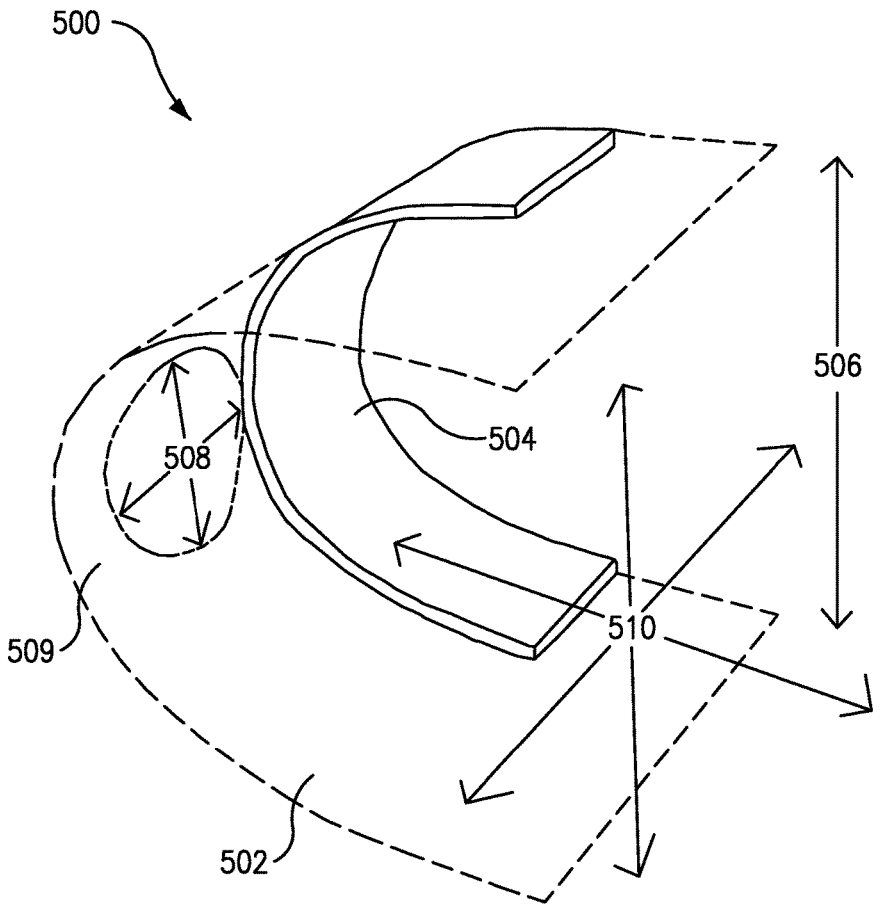
FIG. 5B is a front oblique view of the functional framework of FIG. 4A aligned horizontally to represent a side-lying position of the illustrative embodiment and various other possible embodiments of the invention.
Figure 6:
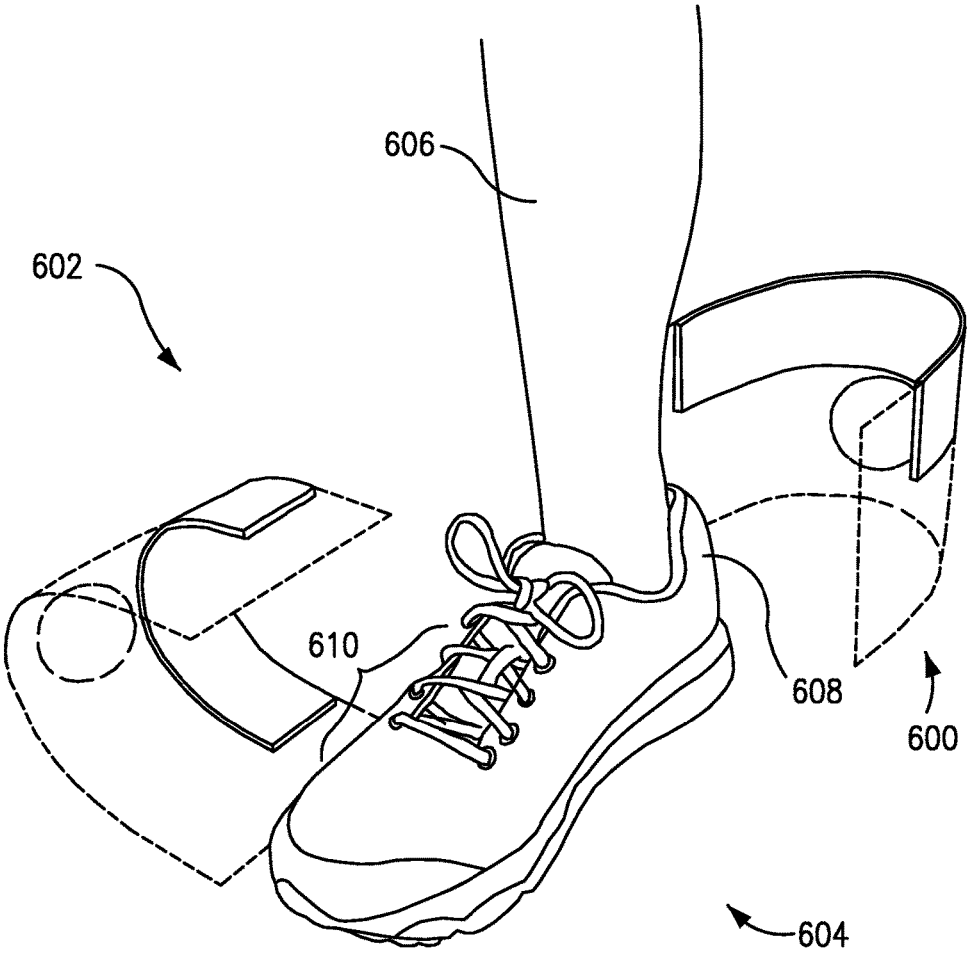
FIG. 6 is a front oblique view of the functional framework renderings of FIG. 5A and FIG. 5B positioned in their functional relation to a user's lower extremity.

FIGS. 4-6 introduce some basic structure and function of the invention, specifically: FIG. 4 is an unembellished illustrative embodiment of the invention; FIGS. 5A and 5B are front oblique views of a functional framework of the illustrative embodiment; and FIG. 6 is a front oblique view of the functional framework renderings of FIG. 5A and FIG. 5B positioned in their functional relation to a user's lower extremity.

4

FIG. 4 is an unembellished illustrative embodiment 400 of the invention. The embodiment shown 400 comprises a self-standing sling configured to wrap securely around a portion of a user's lower extremity, and a resistance harness connected to the sling and capable of delivering resistance to the sling. The sling includes a supportive scaffold 402 to help the sling stand up and open. The resistance harness shown includes a band 404 connected to the sling, and a ring 406 for engaging a resistance-transmitting line 407 and thereby facilitating delivery of force of resistance from the line 407 to the sling.

The sling further includes a heel socket 408 for receiving a user's heel in the case of hip extension exercise. The heel socket 408 shown here is a circular hole, but it can take other structural forms and/or assume other shapes, as further shown and described below. In the case of substantial hip abduction exercise, the heel socket 408 is not used in its capacity to hold the heel, but simply deforms around the user's lateral foot instead. The harness and its elements 404, 406 are adapted to provide a clearance space located opposite the heel socket 408, relative to the sling, to facilitate insertion of the foot for use.

The supportive scaffold 402 is able to structurally support a constant open shape to the sling, regardless of whether the sling is standing upright or is side-lying. The supportive scaffold 402 further includes an upper band 410, and in this embodiment the sling also includes a lower heel stay 412, which in this case is a heel strap 412. When in the upright position, the upper band 410 is adapted to receive and contain the user's posterior leg above their heel apex, for substantial hip extension. When in the side-lying position, on the other hand, the upper band 410 is able to receive and contain the user's lateral foot for substantial hip abduction.

While analogs of the heel socket 408 and upper band 410 can be found in some of the prior art such as the embodiments of FIGS. 2 and 3, their combined arrangement in this illustrative embodiment is wholly different. Owing to the structural integrity of the supportive scaffold 402, the heel socket 408 sits in a position ready to receive a user's heel and the upper band 410 sits in a position ready to wrap around the user's posterior leg, in the case of hip extension. The lower heel stay 41 (here, a heel strap 412) is also strategically positioned to contain the user's foot, again in the case of hip extension.

Moreover, the scaffold 402 enables the sling to maintain its open position even when side-lying, with the upper band 410 sitting in a position ready to wrap around the user's lateral foot in the case of hip abduction. In both cases, the scaffold 402 can employ a spring function that induces the sling to expand and assume a semi-rigid open state for receiving the user's foot when not in use. Yet when the sling is in use the scaffold 402 is also capable of yielding, thereby enabling the sling to wrap securely around the desired portion of the user's lower extremity for any combination of hip extension and/or hip abduction exercise.

The unique functional arrangement of the sling elements is highlighted by the columned surface 415. In contrast to the prior art of FIGS. 2 and 3, the socket 408 and the upper band 410 (as well as the heel strap 412) are shaped and positioned relative to each other so as to substantially conform laterally about the common columned surface 415. Also in this embodiment, the socket 408 lies substantially in a vertical plane, and both the upper band 410 and heel strap 412 lie in substantially parallel horizontal planes—thereby rendering the functional arrangement even more highly tailored for ease of employment.

This unique functional arrangement provides for a central pathway of clearance 418 for the efficient and easy insertion and engagement for use of the user's lower extremity. As shown, the central pathway 418 runs through a center of area circumscribed by the upper band 410, at an angle perpendicular to the plane in which the upper band sits ("upper band plane"). Also as shown, the clearance space extends bidirectionally along the central pathway 418 to pass through and beyond the sling in its entirety, both above and below the sling. Such central clearance pathway 418 is fundamental to proper extension and abduction exercise, for it represents the central position and orientation of the user's lower extremity during loading and use, as taught and described below.

These elements are specially arranged to allow a user to insert their foot and engage the sling for proper use without any manual effort. The columned surface 415 is a visual representation of the key portion of the user's anatomy to be wrapped by the sling during use for gluteal exercise. Whether it be the user's posterior leg and heel as in the case of hip extension, or the user's lateral foot as in the case of hip abduction, the anatomy to be received by the sling is always a substantially columned surface of sorts. In stark contrast to FIGS. 1, 2 and 3, the illustrative embodiment 400, along with its sibling embodiments shown below, stands ever ready to receive and contain a user's foot and/or leg for exercise.

The important features of the present invention have been highlighted in this graphically illustrative design 400. This combination of key structural elements and their respective positional relationships can be rendered in a variety of possible embodiments. This relatively unembellished embodiment 400 is shown primarily for illustrative purposes. It is a simple representation of one of the most basic structurally feasible embodiments that supports a core functional objective of the invention. A "functional framework" for enabling this core objective is explained further in connection FIGS. 5A and 5B below.

The functional framework is a functional arrangement of key elements which enable a user to easily insert their foot, without any manual effort required, to perform full range of motion for any combination of hip extension and/or abduction under resistance. The key elements and their positions in relation to each other make up the framework, which is present in this embodiment 400 and is analyzed in isolation in FIGS. 5A and 5B. The functional framework can be manifest in many different structural designs, of which the exemplary embodiments shown, taught and described below are but a few possibilities.

5

FIG. 5A is a front oblique view of a functional framework 500 of the illustrative embodiment 400 and various other possible embodiments of the invention. The functional framework 500 is an isolated grouping of key elements of the illustrative embodiment, which together are responsible for enabling a core functional objective of the present invention. Specifically, the geometrical alignment, spatial relationship, and relative positioning of these elements enable a user to easily insert their foot for exercise to perform full range of motion for any combination of hip extension and hip abduction, without any manual effort required. FIG. 5A shows the functional framework 500 in an upright position.

The functional framework in the upright position is ready to receive a user's foot and lower leg for hip extension. It includes a scaffold frame 502 which outlines a generic potential area for a supportive scaffold of a sling. Included in the broad area of the scaffold frame 502 is an upper band 504, adapted to receive and contain a user's posterior leg above their heel apex during hip extension. In some embodiments the upper band 504 not only surrounds the user's posterior leg, but can also envelop a harness element (such as a belt) and/or even a portion of a resistance-transmitting line (such as an elastic band).

The upper band 504 is positioned at an elevation 506 above the floor, at the top of the scaffold frame 502. The structural strength of the supportive scaffold can support this elevation of the upper band 504. The scaffold frame 502 includes a heel socket 508 located below the upper band 504 for receiving, surrounding and facilitating rotational movement of a user's heel during hip extension. The heel socket 508 can take a variety of shapes and sizes. It is indicated here as a circular hole, but it can be a slit between two horizontal bands or even a pocket rather than a hole, for example.

In this functional framework, a lower heel stay area 509 is also shown below the heel socket 508, also providing a bottom border of the heel socket 508. The lower heel stay area 509 can be an advantageous design feature for the scaffold frame 502. It represents a potential area of a lower heel stay element, which can secure itself under the lower heel to prevent the sling from migrating up the leg during hip extension exercise. The lower heel stay can be a lower band that is structurally integral to the supportive scaffold itself, or it can be a heel strap attached to the supportive scaffold, for example.

Another key element of the functional framework 500 is the clearance space 510 opposite the heel socket 508, relative to the full sling body. This clearance space 510 allows a user to insert their foot into the sling and into position for use, including positioning their heel in the heel socket 508. The harness (not shown) is adapted to provide this clearance space 510 in a way that is not provided in the prior art. The clearance space 510 functions cooperatively with the scaffold frame 502 and its elements, to enable a user to step in and engage the device for use with no manual effort.

Once the user inserts his foot into the sling for use during hip extension exercise, the rearward force of their heel against the heel socket 508 counters the forward force of the resistance-transmitting line that is delivered through the harness. These opposing forces induce the supportive scaffold to yield its rigid shape and enfold itself around the user's heel and posterior leg during use. In this way, the unique ensemble of elements and their strategic spatial relationship provides an organic response to the user's pedal engagement with the device.

FIG. 5B is a front oblique view of the functional framework 500 of FIG. 4A aligned horizontally to represent a side-lying position of the illustrative embodiment 400 and various other possible embodiments of the invention. The functional framework in the side-lying position is ready to receive a user's foot for hip abduction. Some functional elements of the functional framework 500 such as the heel socket 508 and heel stay area 509 are less centrally relevant to use during hip abduction, while other functional elements such as the scaffold frame 502, upper band 504 and clearance space 510 take on a slightly modified though no less relevant function.

In this side-lying position, the upper band 504 once again spans a vertical height 506 above the floor. In this configuration, the upper band 504 is ready to receive and contain a user's lateral foot for hip abduction. The heel socket 508 and lower heel stay area 509 do not acquire any specific functional relationship to the user's anatomy in the case of hip abduction exercise. Rather, they simply deform around the lateral foot, and are not as integral to containment of the lateral foot as is the upper band 504. However, the clearance space 510 is as crucial to the side-lying functional framework as it is to the upright standing functional framework, and for the same reason: clearance for the foot.

As in the case of the upright functional framework, here again the clearance space 510 allows a user to insert their foot into the sling and into position for use, including positioning their lateral foot into the concavity of and against the interior surface of upper band 504. The clearance space 510 once again functions cooperatively with the scaffold frame 502 and its relevant elements, in this case most especially the upper band 504, to enable the user to step in and engage the device for use with no manual effort.

Once the user inserts his foot into the sling for use during hip abduction exercise, the lateral force of their lateral foot against the inside of the upper band 504 counters the medial force of the resistance-transmitting line that is delivered through the harness. These opposing forces induce the supportive scaffold to yield its rigid shape and enfold itself around the user's lateral foot during use. In this way, the unique ensemble of elements and their strategic spatial relationship provides an organic response to the user's pedal engagement with the device.

6

FIG. 6 is a front oblique view of the functional framework renderings of FIG. 5A and FIG. 5B positioned in their respective functional relations 600, 602 to a user's lower extremity 608. Upon careful viewing, it becomes readily apparent how both the upright functional framework 600 and the side-lying functional framework 602 are naturally poised to receive the user's exercising foot 604 and leg 606 for hip extension and/or hip abduction exercise.

The upright functional framework 600 stands ready to receive the back 608 of the user's exercising foot 610 and posterior leg for hip extension; while the side-lying functional framework 602 lies ready to receive the lateral side of the user's exercising foot 604 for hip abduction. Because of the semi-rigid strength of the functional framework no matter the position 600, 602, the user can easily topple the standing framework 600 to a side-lying position 602, or vice versa, with their foot.

It should be noted that the functional framework 600 is able to direct resistance force against key strategic anatomical areas, for each type of exercise employed by the user. In the case of hip extension, the functional framework 600 directs the resistance of the line against the user's posterior leg above their heel apex throughout the full range of hip extension. This enables the strong columned surface of the posterior leg to absorb the force, optimizing transfer of forces during exercise.

Meanwhile, the side-lying functional framework 602 is designed to concentrate resistance force at the user's lateral midfoot throughout hip abduction. The upper band concentrates this resistance force against the midfoot, distributing it evenly across its flat inner surface. Only through such targeted distribution about the lateral midfoot (with its stout, sturdy bones, strong ligaments and large tendons) can the user safely abduct their hip—even at maximal muscle engagement with heavy weight.

Key Functionalities

Figure 7A:
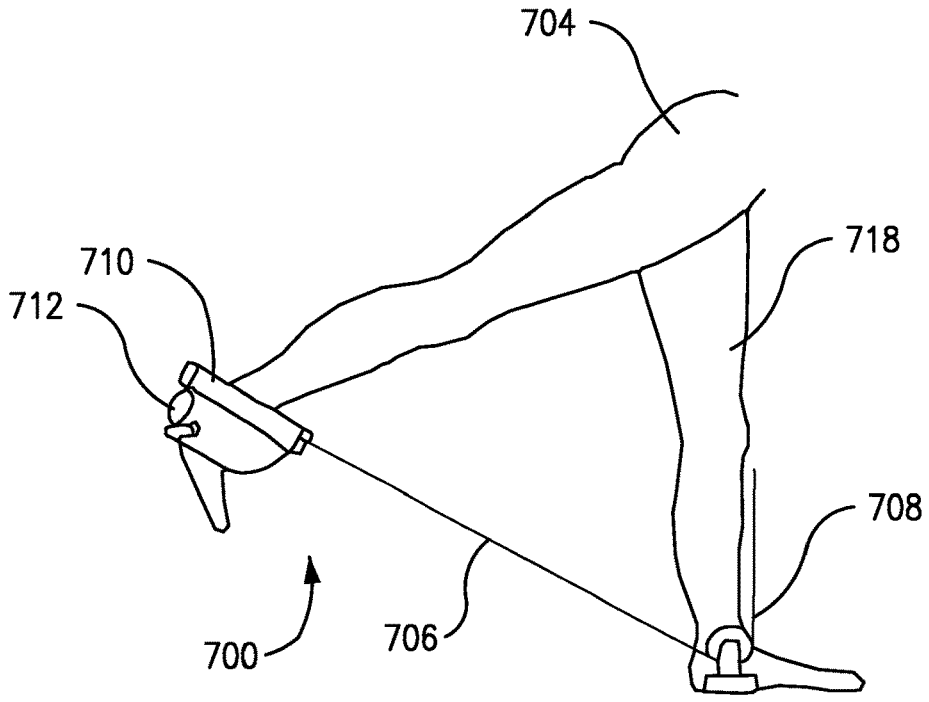
FIG. 7A is a profile view of a user using an embodiment of the invention to perform hip extension, the user's ankle remaining in a neutral position near the apex of exercise.
Figure 7B:
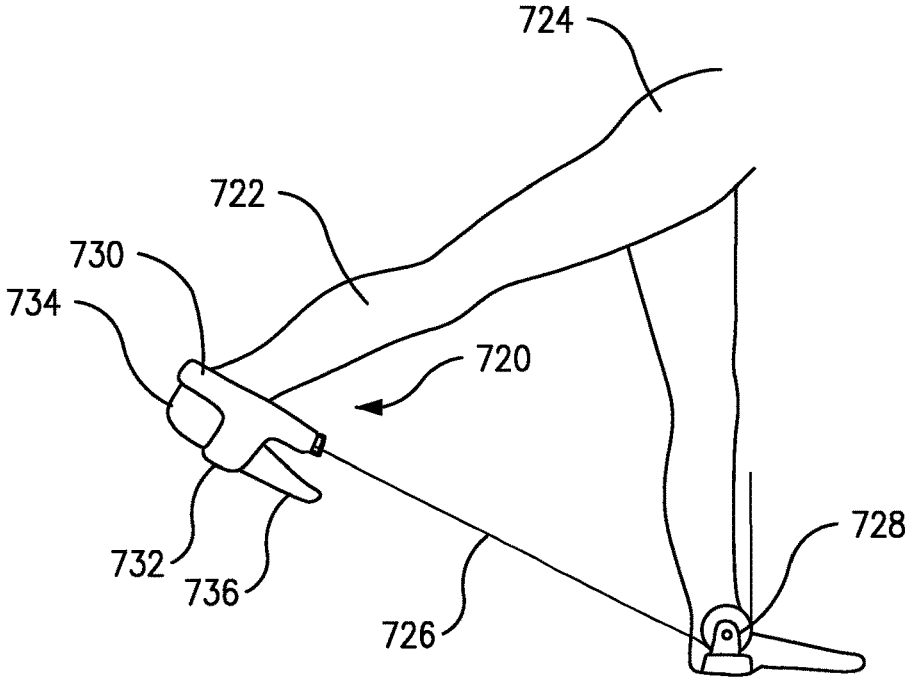
FIG. 7B is a profile view of a user using an adaptation to the embodiment of FIG. 2 to perform hip extension, the user's ankle being forced into dorsiflexion.
Figure 8:
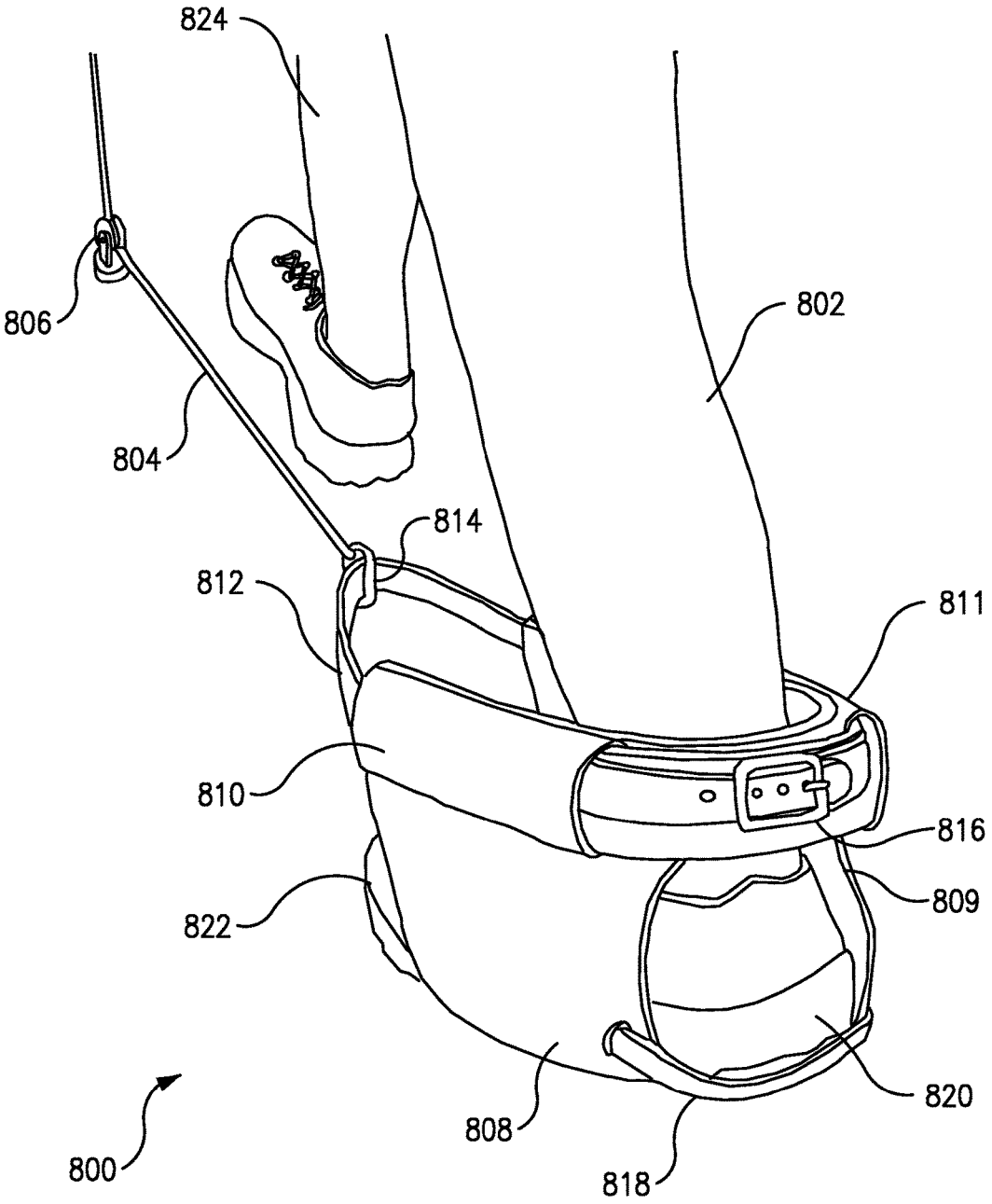
Figure 9:
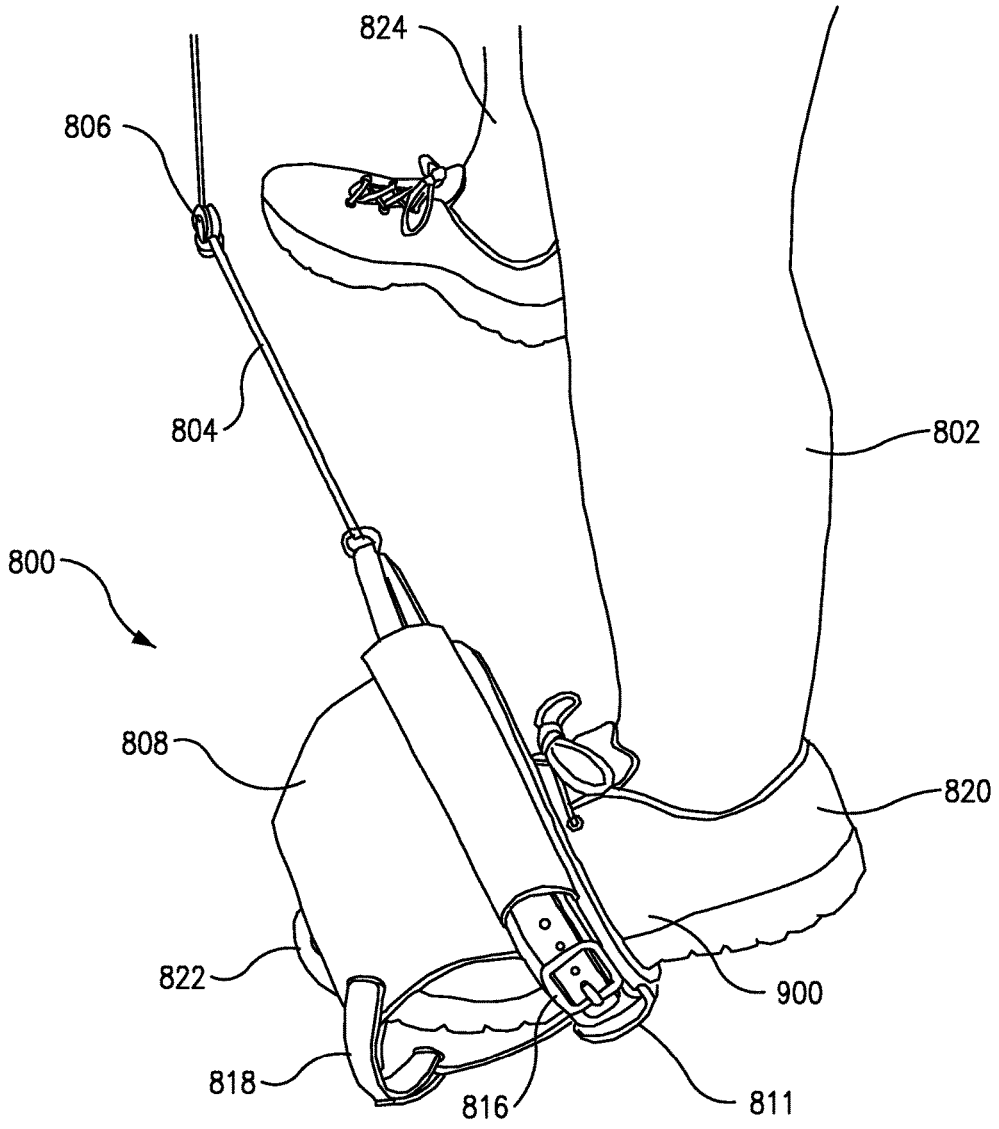

FIGS. 7-9 illustrate key functionalities, specifically: FIG. 7A and FIG. 7B compare hip extension using an embodiment of the invention, to hip extension using an embodiment of the prior art; FIG. 8 is a rear oblique view of an embodiment of the invention wrapped around a user's posterior leg and foot during hip extension exercise; and FIG. 9 is a rear oblique view of the embodiment of FIG. 8 wrapped around a user's lateral foot during hip abduction exercise.

7

FIG. 7A is a profile view of a user using an embodiment 700 of the invention to perform hip extension, the user's ankle remaining in a neutral position near the apex of exercise. The user lifts their exercising leg 702 to work their buttock area 704, and a resistance-transmitting line 706 transmits force directed from a pulley 708 to resist their leg movement and thereby enhance their muscle training experience. In the embodiment shown, the resistance is transmitted specifically to the upper band 710 and through it to the posterior leg above the heel apex.

A heel strap 712 hooks under the heel, anchoring the sling in a fixed position relative to the user's heel 714 but not relative to their entire foot 716. Due to the strength and spatial extent of the scaffold, the heel strap 712 need not bear the burden of standing the sling upright. Thus, the heel strap 712 can be positioned most advantageously for the user's foot, without regard for the structural integrity of the sling. The heel strap 712 catches under the heel 714 but does not hinder the neutral position of the foot 716, which naturally points down as the leg 702 is raised. The foot 716 is not forced into flexion or extension, but is allowed to remain in its natural anatomical position.

FIG. 7B is a profile view of a user using an adaptation 720 to the embodiment of FIG. 2 to perform hip extension, the user's ankle being forced into dorsiflexion. The user again lifts their exercising leg 722 to work their buttock area 724, and a resistance-transmitting line 726 transmits force directed from a pulley 728 to resist their leg movement and thereby enhance their muscle training. In the embodiment shown, the resistance is transmitted specifically to the upper band 730 and through it to the posterior leg above the heel apex.

A lower band 732 is positioned under the foot, anchoring the sling in a fixed position relative to the user's heel 734 and foot 736. Due to the lack of a separate scaffold, the lower band 732 is forced to bear the burden of standing the sling upright to be ready to receive the foot 732 for use. Thus, the lower band 732 cannot be positioned advantageously for the user's foot, as it must also provide structural integrity of the sling. The lower band 732 thus hinders the neutral position of the foot 736, which is hyperflexed as the leg 722 is raised. By carrying forward the design principles of the prior art, the foot 736 is forced out of its natural anatomical position.

The illustrations of FIGS. 7A and 7B are juxtaposed to highlight the fact that certain fundamental principles of a core functional framework of the invention contradict and transcend basic design principles of the prior art, in fundamental ways. It is made readily apparent to a viewer that the design approach for the prior art of FIG. 2 did not contemplate a device that could stand ready to receive the foot without manual application. If such a design approach were followed in attempts to provide a hands-free pedal engagement experience, hip extension exercise would be severely compromised and full range of leg motion prevented.

8

FIG. 8 is a rear oblique view of an embodiment 800 of the invention wrapped around a user's posterior leg and foot during hip extension exercise. A user pulls their exercising leg 802 back to extend their hip, while the device 800 absorbs resistance from a resistance-transmitting line 804 in communication with a pulley 806. The device 800 includes a supportive scaffold with two supportive walls 808, 809 and an upper band with two loops 810, 811 for housing a belt harness 812.

The loops 810, 811 can be sewn, glued or even screwed to the body of the sling, as a few exemplary means of attachment. In some embodiments, the loops 810, 811 can be selectively opened and closed, for example by Velcro attachment or by zipper along a lengthwise seam. This can facilitate insertion of the belt harness 812 into the loops 810, 811, which can be opened to allow the harness 812, and then closed to secure and fasten the harness 812. A ring 814 connects the belt harness 812 to the resistance-transmitting line 804, enabling the belt harness 812 to deliver resistance to the device 800. The belt 812 is circumference-adjustable by a buckle 816.

The user is able to engage the device 800 with their foot without manual effort, and extend their hip through full range of motion. A heel strap 818 hooks under the heel 820 of the user's foot 822, and secures the device 800 to the user's foot throughout the entire duration of hip extension, as the user supports themselves with their standing leg 824. The supportive scaffold walls 808, 809 do not obstruct the natural rotational movement of the user's foot 822, thus enabling them to maintain its neutral anatomical position relative to the leg 802.

9

FIG. 9 is a rear oblique view of the embodiment 800 of FIG. 8 wrapped around a user's lateral foot 900 during hip abduction exercise. The user pulls their exercising leg 802 laterally to abduct their hip, while the device 800 absorbs resistance from the line 804 in communication with the pulley. The upper band and belt cooperate in containing the user's lateral foot 900, as the hip is abducted through full range of motion. The supportive scaffold walls 808, 809 provide clearance for the front of the user's foot 822 during exercise.

One leg exercise that is particularly effective for gluteal exercise is a combination of hip extension and hip abduction. FIG. 9 aptly shows what this might look like: the user's leg 802 is brought both backwards and outwards, 45 degrees from the Sagittal plane. The design of this device 800 naturally promotes the proper form for hybrid extension-abduction, which includes external rotation of the hip. Because the device 800 only contains the lateral foot 900 when the foot 822 is perpendicular to the line 804, the user must rotate their foot 822 (and hence their hip) externally, lest the device would slip off, thus additionally enlisting the hip external rotator musculature (upper gluteus maximus fibers).

Exemplary Embodiments

Figure 10:
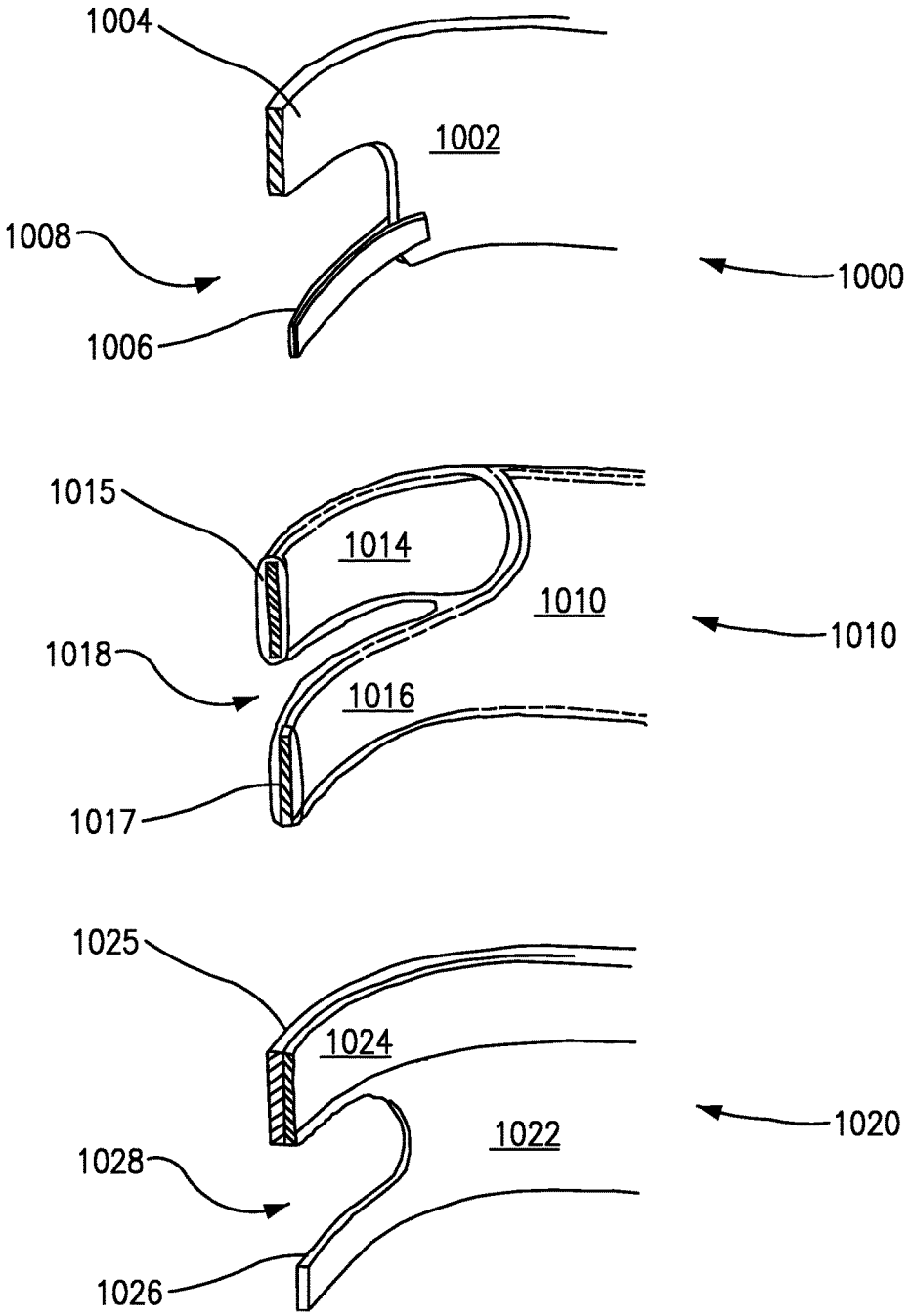
Figure 11:
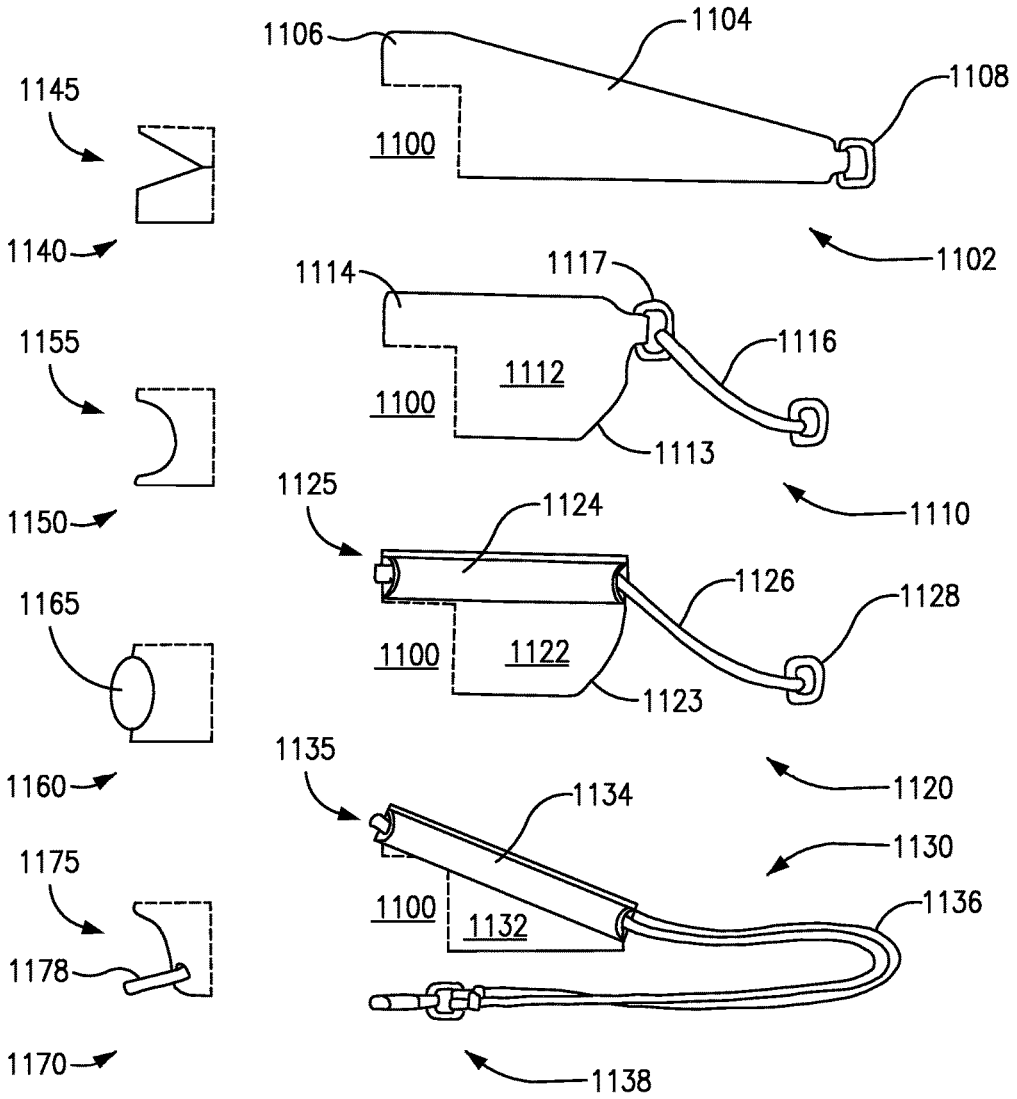
Figure 12A:
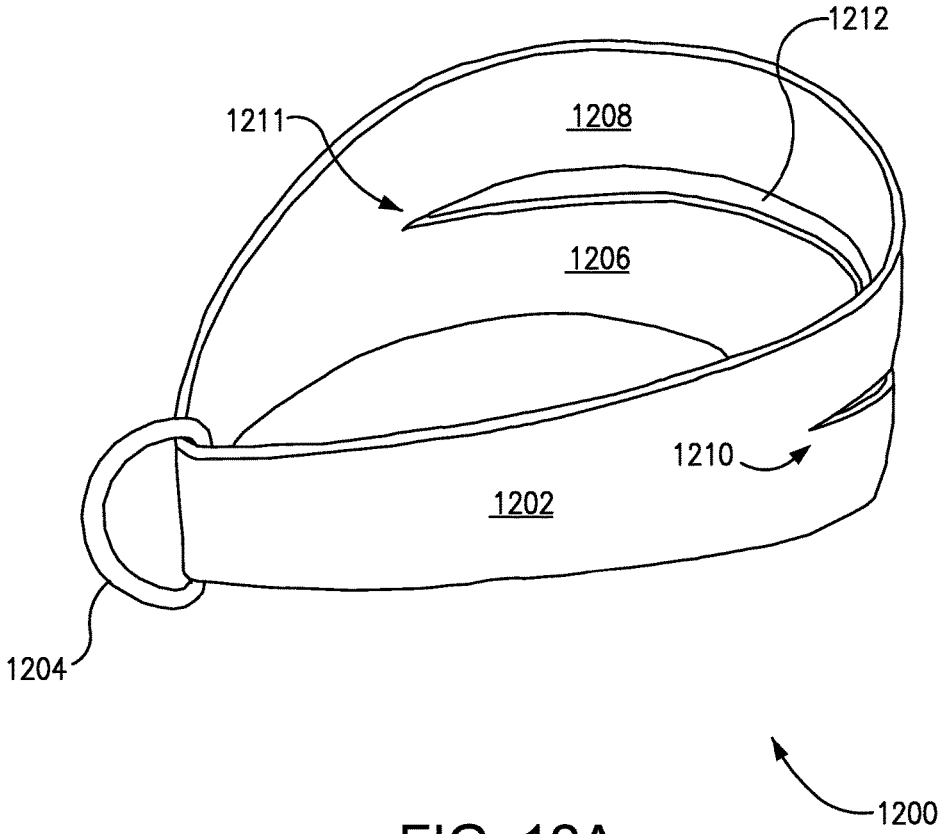
FIG. 12A is a rear oblique view of a possible commercial embodiment of the invention that includes a lower band.
Figure 12B:
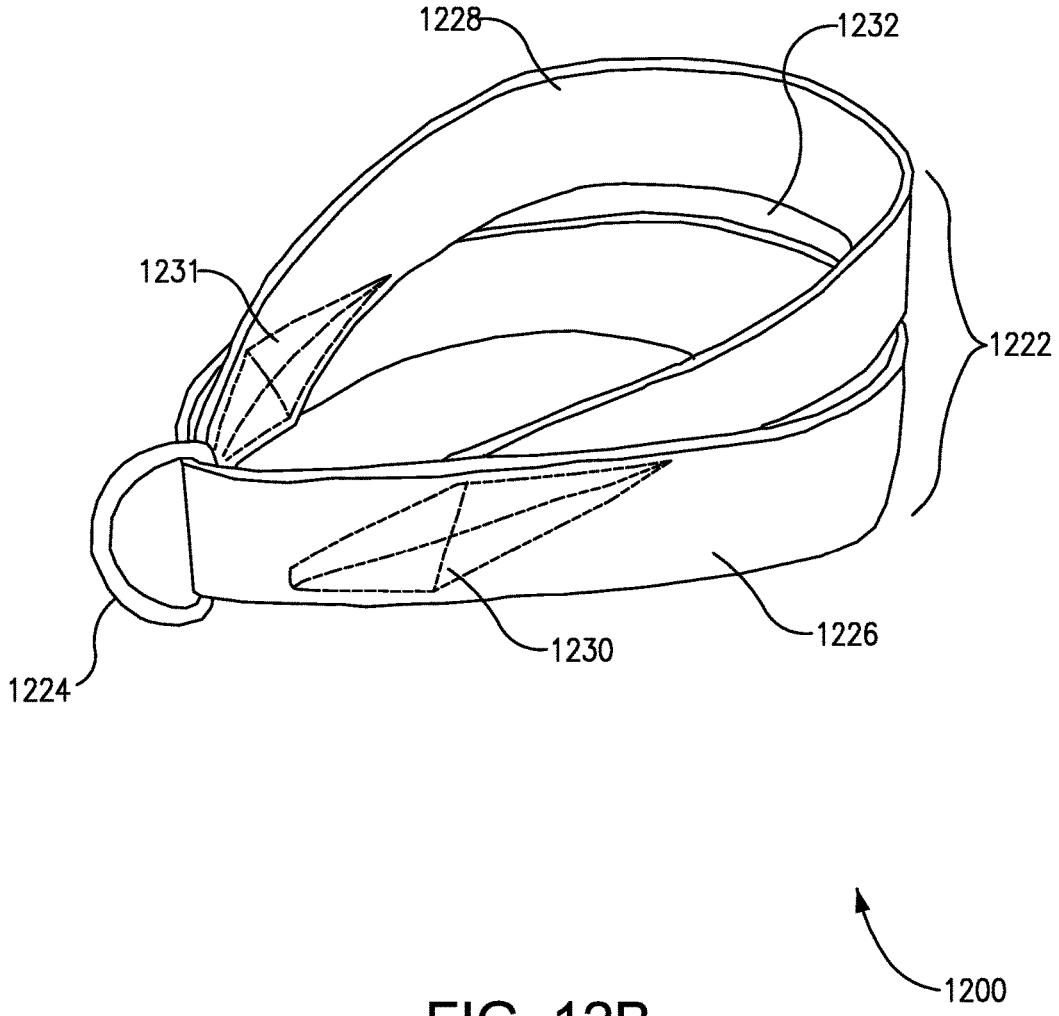
FIG. 12B is a rear oblique view of a possible embodiment of the invention that includes straps joined to give sufficient structural support to the sling.
Figure 13:
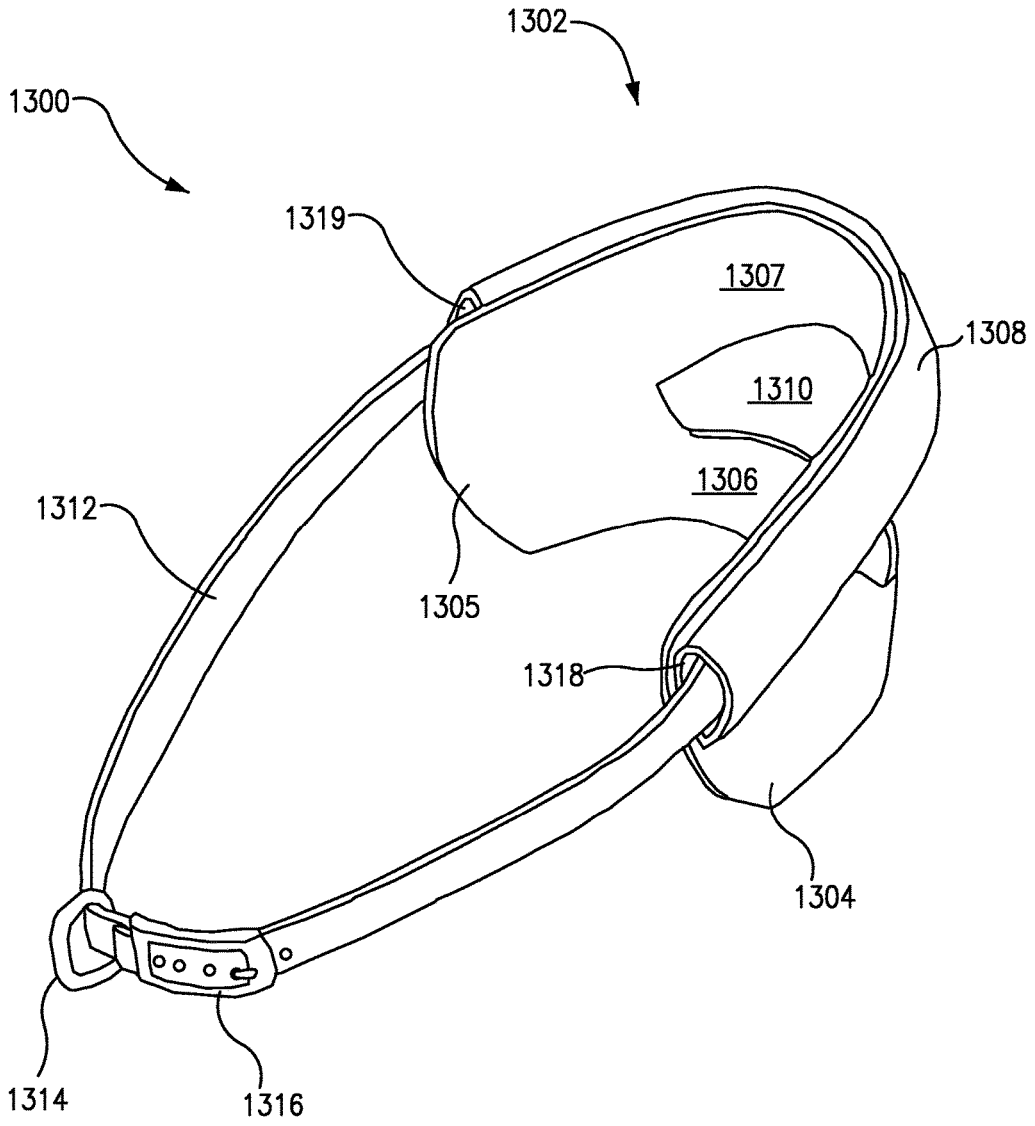
Figure 14:
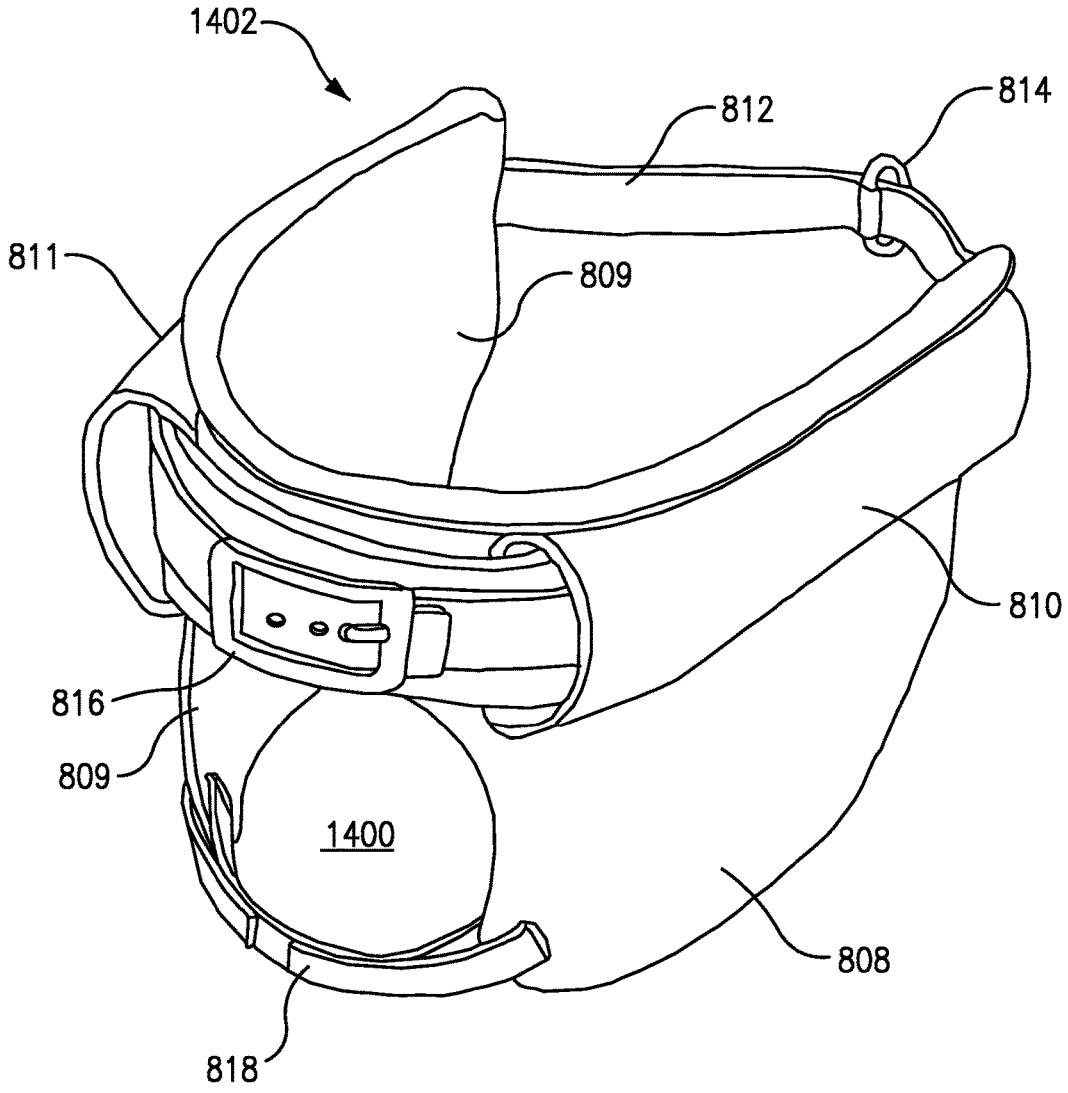
Figure 15:
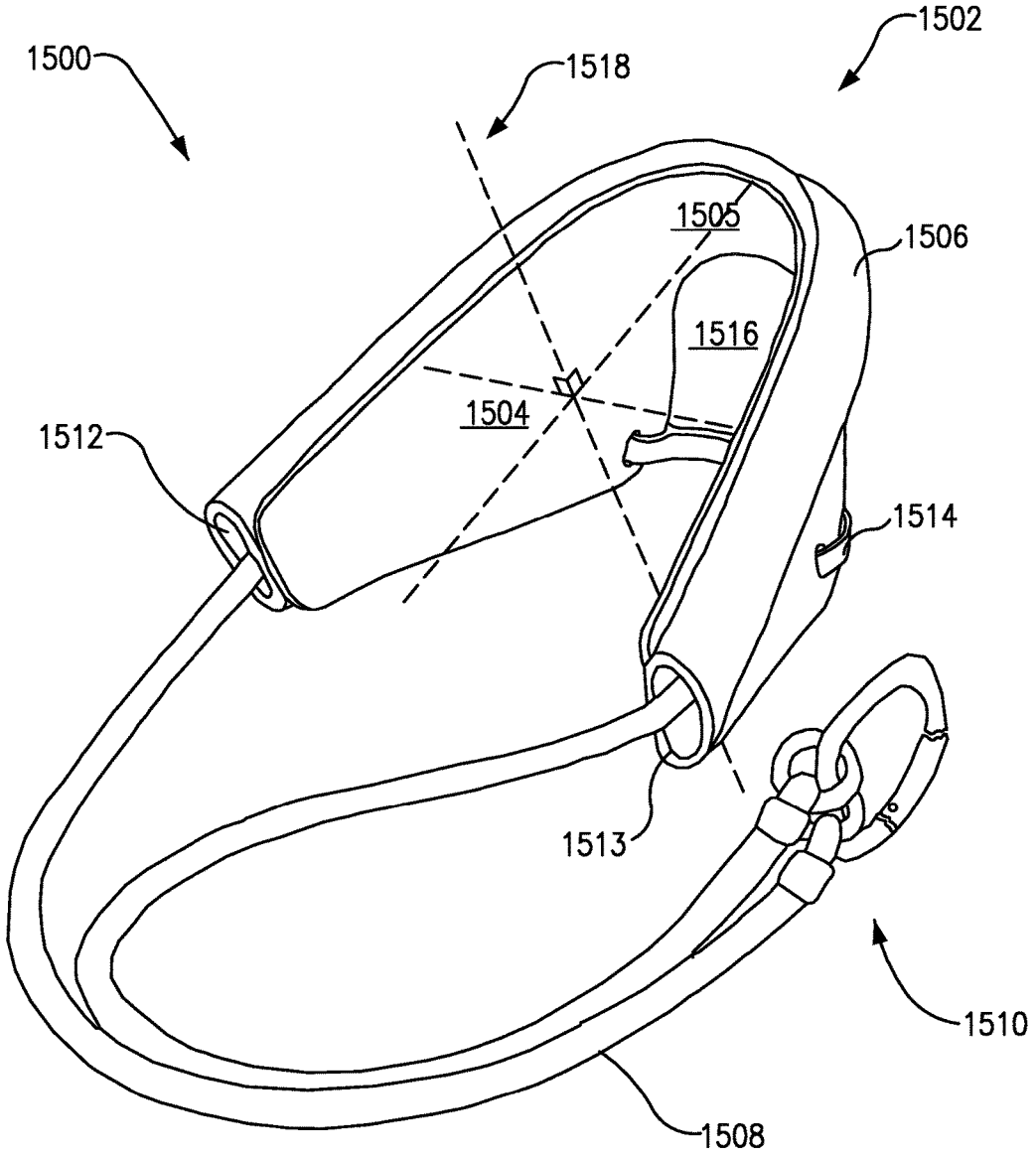

FIGS. 10-15 show exemplary embodiments, specifically: FIG. 10 illustrates possible structural support arrangements of a sling; FIG. 11 is an illustration of design components for various possible embodiments of a socket, scaffold and harness; FIGS. 12 and 13 are front oblique views of possible commercial embodiments of the invention that include a lower band; FIG. 14 is a front oblique view of the embodiment of FIG. 8 which includes a channel that houses a belt; and FIG. 15 is a front oblique view of an embodiment that includes a channel that houses an elastic resistance line.

10

FIG. 10 is an illustration of structural support arrangements 1000, 1010, 1020 for various possible embodiments of a sling, in accordance with the invention. One possible structural support arrangement for the sling is an "unibody" 1000. In the unibody embodiment 1000, the supportive scaffold 1002 makes up the major body of the sling, including the upper band 1004. In this embodiment, the upper band 104 is of the same constitution as the supportive scaffold 1002, and thus it has its own structural integrity with which to accomplish all its functions. The supportive scaffold 1002 and upper band 1004 function as a single body with its own spring function.

Attached to a bottom corner of each side of the supportive scaffold 1002 of this embodiment 1000 is a heel strap 1006. This heel strap 1006 can be made from a separate material, such as cloth for example, distinct from the more springy and semi-rigid material of the supportive scaffold 1002 itself. The space bounded by the supportive scaffold 1002 walls, the upper band 1004 and the heel strap 1006 is a generally rounded heel socket 1008 that is capable of surrounding and facilitating rotational movement of the user's heel.

Another possible structural support arrangement for a sling is an "endoskeleton"1010. In the endoskeleton embodiment 1010, a cushioned outer skin 1012 can surround an interior structural support frame. This arrangement can be seen in cross section view, where a skin portion 1014 of the upper band encloses an endoskeleton portion 1015 of the upper band, and a skin portion 1016 of a lower band encloses an endoskeleton portion 1017 of the lower band.

The supportive scaffold serves as the endoskeleton, extending as bands beneath the band cushions and extending as a wall within the sidewall cushion 1012.

In the embodiment discussed 1010, a heel socket 1018 is formed as a slit between the upper and lower bands. The lower band 1016, 1017 functions as a lower heel stay, in addition to contributing substantial spring strength to the sling. The heel socket 1018 widens to receive the user's heel upon the user's insertion of their foot into the sling for use. As they apply pressure to the bands with their foot and posterior leg, the bands separate as the lower band migrates below the heel to serve as the lower heel stay, thus widening the heel socket and thereby making room for the user's heel.

Yet another possible structural support arrangement for a sling is a "exoskeleton" 1020. In the exoskeleton embodiment 1020, the supportive scaffold 1022 utilizes a lighter structure to lift the upper band in the upright position. The spring function is manifest in an added 'spring band' connective element, 1025, attached to the scaffold. In this embodiment 1020, the lower band 1026 can be made thinner to create a more naturally rounded heel socket hole 1028, or can be a heel strap instead. The spring band 1024 can be advantageously used to attach a harness channel to the scaffold.

In all these possible structural support arrangements, and in still others not discussed but under contemplation by one of ordinary skill in the art, it may be preferable for certain material properties to be present in all or part of the supporting scaffold. Toughness, or the capability of absorbing energy and plastically or elastically deforming without fracture, is important; as is resilience, or the capability of releasing that energy upon unloading. A semi-rigid material that can still uphold the functional framework, yet demonstrate toughness and resilience, is key.

Plastic is an ideal material for the skeletal body of a supporting scaffold. Plastic can be semi-rigid, and strong but light, and preferably capable of deformation around the foot and/or shoe during application of resistance. The shape of the scaffold can be molded with plastic construction, utilizing injection or thermal molding, for example. The edges can be flared out and curved on their inner surface, to minimize interference with the user's lower extremity. It can be advantageous for the surface to have a low coefficient of friction.

In the case of an embodiment that includes separate cushioning material, an upholstered fabric such as vinyl or cloth could be used, for example. Again, it is advantageous for the surface to be of low friction. In some cases, the upper band can include loops through which a belt or resistance line can run. It is advantageous for the loops to be attached to the outside of the scaffold, so as to distribute and diffuse the concentrated force of resistance from the line.

Any such loops can be made of a strong but supple material, such as leather or naugahyde, for example. A belt to pass through the loops could be of a nylon or polyester webbing, or leather, for example. Leather could also be used for much of the sling in some embodiments, potentially with a steel spring sewn in or embedded into the leather frame so as to induce the spring action that would normally be achieved by the material itself, in the case of a plastic sling skeleton for example.

The material for the scaffold can be designed as non-porous and washable, thus rendering it cleanable and sterilizable for a public gym environment. The strength, constitution, shape and other aspects of the materials used can be drawn from a wide array of possibilities, and are best selected with the specific design goals in mind. For example, a material of significant strength may desirable for a scaffold that spans a shorter circumferential segment, to guard against and resist the scaffold's comparatively higher susceptibility to deformation during exercise under resistance.

11

FIG. 11 is an illustration of design components for various possible embodiments of a socket, scaffold and harness in accordance with the invention. Two columns of possible device components are presented, whereby the socket area component in the left column of FIG. 11 can be joined with the sling and harness component in the right column of FIG. 11, via the socket space 1100. Any socket component shown can be joined with any sling and harness component shown, yet even more components besides those shown may be included within the scope of the invention as claimed and taught.

One possible embodiment of a sling and harness component 1102 includes a supportive scaffold with its top edge 1104 aligned substantially at an acute angle relative to the bottom edge of the sling, the angle's vertex being opposite the socket space 1100. The angle of the top edge 1104 levels out in the area of the upper band 1106, facilitating a more natural surrounding of the posterior leg above the heel apex. At the vertex of the angle of the top edge 1104 of the sling, the harness includes a ring 1108 for connecting to a line.

Another possible embodiment of a sling and harness component 1110 includes a supporting scaffold portion 1112 and its associated upper band 1114 serving as a sling, and a connecting band 1116 attached to the scaffold portion 1112 via an intermediate ring 1117 and also including a line-connecting ring 1118 all functioning as a harness. In this embodiment 1110, the top edge of the supporting scaffold wall 1112 is level, but the proximal portion of the bottom edge 1113 of the wall is contoured to allow the device to move freely without obstruction during completion of a hip extension repetition.

Another possible embodiment of a sling and harness component 1120 includes a supporting scaffold portion 1122 and its associated upper band element 1124 serving as a sling, and a belt 1126 functioning as a harness. The upper band in this embodiment 1120 is an upper band envelope 1124 that receives the posterior leg directly. A leg-surrounding portion 1125 of a belt 1126 passes through the envelope 1124. The belt itself 1126 also contributes harness functionality, along with a ring 1128 with which is connected. The belt 1126 runs through the upper band envelope 1124, thereby reinforcing the function of the upper band itself.

Yet another possible embodiment of a sling and harness component 1130 includes a supporting scaffold portion 1132 and an associated upper band element 1134 serving as a sling, the upper band element 1134 being aligned substantially at an acute angle relative to the bottom edge of the sling. The upper band in this embodiment 1130 is an upper band envelope 1134 that receives the poster leg directly. A leg-surrounding portion 1135 of an elastic band 1136 passes through the envelope 1136. The elastic band 1136 is itself the resistance-transmitting line, and also contributes harness functionality. A locking gate 1138 is connected to the proximal end of the elastic band 1136.

Other embodiments can include a pair of more widely positioned loops, instead of the comparatively more tightly constricted band envelopes 1124, 1134 shown and discussed in relation to some embodiments 1120, 1130. The loops may be set apart from each other to allow for easier threading through of a belt harness 1126 or a resistance-transmitting line 1136. Furthermore, in either case the loops or envelope can be selectively opened or closed, for example along a lengthwise seam. This can be easily achieved via a hook-and-loops fastener such as Velcro or a zipper, as examples. Such a seam can facilitate the insertion of either a belt harness or an elastic band.

In embodiments including elements that might be made, used or sold separately, such as a connecting band 1116, intermediate ring 1117, belt and/or connecting ring 1118, 1128, it will be readily apparent that various connective portions of the scaffold itself could be considered a harness, insofar as they engage with these other elements to deliver resistance transmitted by a resistance-transmitting line. Such integrated harness elements can include a portion of a scaffold 1112 that connects with an intermediate ring 1117, the envelope 1124 that houses a belt 1126, or the envelope 1134 that houses an elastic band 1136, for example.

Upper band envelopes such as those being taught and described here, 1124, 1136, include loops, through which a belt 1126 or resistance-transmitting line 1136, for example, can pass. In embodiments shown here, 1120, 1130, each upper band envelope 1124, 1134, includes a loop of substantial width on either side of the sling. The width of each loop extends substantially along the entire respective side of the upper band's circumference. Such wide loops can be interpreted as long channels, and even a pair of loops can be considered one long, circumferential channel having a small hand-accessible hole at their distal apexes 1125, 1135.

In each of the sling and harness components shown and described here, 1102, 1110, 1120, 1130, their socket space 1100 can accommodate any of the following socket components, or even others besides. One of ordinary skill in the art will readily appreciate that other socket components could be used to accomplish the function of a socket as laid out in this specification, namely: surrounding and facilitating rotational movement of a user's heel throughout substantial hip extension exercise, and deforming around the user's lateral foot during substantial hip abduction exercise.

One possible embodiment of a harness component 1140 includes a slit 1145 such as could occur naturally between two bands, such a slit tapering to a point at each of its edges, as indicated here. Another possible embodiment 1150 can include a hole 1155, such as a rounded hole as indicated here. Still another possible embodiment 1160 can include a material pocket 1165 rather than a hole. Yet another embodiment 1170 can include a space bounded by the upper band above, scaffold walls on the sides, and a heel strap 1178 from below.

12

FIG. 12A is a rear oblique view of a possible commercial embodiment 1200 of the invention that includes a lower band. This embodiment 1200 incorporates a socket component 1145 and sling and harness component 1102 shown and taught in connection with FIG. 11. In this embodiment 1200, a supporting scaffold includes relatively low circumferential wall 1202 at its proximal portion, connected to a ring 1204 which can in turn connect to a resistance-transmitting line.

At its distal portion, the supporting scaffold branches into a lower band 1206 and an upper band 1208. The bands 1206, 1208 converge and merge into the wall 1202 at two lateral points 1210, 1211. The socket 1212 of this embodiment is a slit formed by the separation of the two bands 1206, 1208. The entire body of the supporting scaffold of this embodiment 1202 is a single unbroken structure of the same material.

FIG. 12B is a rear oblique view of a possible embodiment 1220 of the invention that includes straps joined to give sufficient structural support to the sling. While the basic large-scale structure of its supporting scaffold is practically identical to that of FIG. 12A, this embodiment 1220 is unique insofar as its supporting scaffold is composed entirely of simple straps, of the kind that could be found in known devices such as the prior art surveyed above.

A supporting scaffold 1222 is connected to a ring 1204. The scaffold 1222 includes a horizontal lower circumferential strap 1226 that lies on the floor, and a higher strap 1228 that also serves as the upper band. In this embodiment, the structural integrity of the scaffold 1222 is provided by the strategic attachment portions 1230, 1231 where the straps have been joined. The socket 1232 of this embodiment is a slit formed by the separation of the two straps 1226, 1228.

The strength and strategic angle of their attachment 1230, 1231 provides the structural integrity to keep the functional framework of this embodiment 1220 intact throughout all stages of preparation and use. This embodiment 1220 is instructive in that it demonstrates the uniqueness of the functional framework, even when it is constructed from the same type of structural elements as is the prior art. This underscores the uniqueness of the functional framework itself.

13

FIG. 13 is a rear oblique view of another embodiment 1300 of the invention that also includes a lower band. This embodiment 1200 incorporates a socket component 1150 and sling and harness component 1120 shown and taught in connection with FIG. 11. In this embodiment 1300, the sling 1302 spans a semicircle rather than a full circle, and thus its supporting scaffold can be made of sufficiently strong material to resist deformation. The sling includes two sidewalls 1304, 1305, with a lower band 1306 and an upper band 1307 bridging the walls, and a heel socket 1310 bound by the bands 1306, 1307.

In this embodiment 1300, an envelope 1308 runs along the outer surface of the upper band 1307 and houses a belt 1312, acting as a channel through which the belt 1312 can pass. The belt includes a ring 1314 for connecting to a line, and is length-adjustable via a buckle 1316 as one example. It is threaded through the channel 1318 via openings 1318, 1319 at each of the channel's ends. While the channel 1308 can be considered a harness, its function is also reinforced by the belt 1312.

In some embodiments, the harness can include a plurality of loops in place of the more tightly constricted envelope 1308. Such an arrangement may involve loops liberally spaced apart from each other, thus allowing for easier threading through of the belt 1312. Furthermore, in either case (whether the enclosure is an envelope 1308 as shown, or a series of loops), the enclosure can be selectively opened or closed, along a lengthwise seam for example. This can be easily achieved for example by Velcro or a zipper. Such use of a seam can facilitate the insertion of the belt 1312.

Both the channel 1308 and the belt 1312 are capable of functioning as a harness, delivering force of resistance from the line to the sling 1302. In instances where the sling 1302 may be sold by itself, the upper band envelope 1308 can be considered a harness in its own right. Here, the envelope 1308 in its harness capacity is coextensive with the upper band 1307. The envelope here 1308 runs along an outer surface of the upper band 1307. These elements can be structurally dependent, or in some cases potentially even identical.

14

FIG. 14 is a front oblique view of the embodiment 800 of FIG. 8 which includes a heel strap and a channel housing a belt. Here the embodiment 800 is isolated from the user to show its structure more clearly. The heel socket 1400 is clearly visible at this angle, bounded by the scaffold walls 808, 809, upper band (behind the loops 810, 811 and belt 812) and heel strap 818. Also clearly visible in this embodiment is the top edge of the scaffold 1402, strategically curved and flared outwards to minimize catching on the user's foot or leg.

The loops 810, 811 can be sewn, glued or even screwed to the body of the sling, as a few exemplary means of attachment. In some embodiments, the loops 810, 811 can be selectively opened and closed, for example by Velcro attachment or a zipper along a lengthwise seam. This can facilitate insertion of the belt harness 812 into the loops 810, 811, which can be opened to allow the harness 812, and then closed to secure and fasten the harness 812. The belt 812 includes a ring for attachment to the resistance-transmitting line.

15

FIG. 15 is a rear oblique view of another embodiment 1500 of the invention that includes a heel strap and a channel housing an elastic resistance line, one that incorporates a socket component 1150 and sling and harness component 1120 as shown in FIG. 11. Here, the sling 1502 includes sidewalls 1504 and an upper band 1505, with a harness channel 1506 (acting as the resistance harness 1506) attached to the outer surface of the upper band 1505. A line 1508 can be passed through the channel 1506 and serve as a resistance-transmitting line. It is attached at its proximal end to a locking gate 1510 (karabiner), which can lock to an anchor point.

The resistance-transmitting line 1508 can be threaded through the channel 1506 via openings 1512, 1513 at either end of the channel 1506, serving as access points. In some embodiments, the harness can include a plurality of loops in place of the more tightly constricted channel 1506. Such an arrangement may involve loops liberally spaced apart from each other, thus allowing for easier threading through of the line 1508. Furthermore, in either case (whether the enclosure is a channel 1506 as shown, or a series of loops), the enclosure can be selectively opened or closed, along a lengthwise seam for example. This can be easily achieved for example by Velcro or a zipper. Such use of a seam can facilitate the insertion of the line 1508.

In this embodiment 1500, the resistance-transmitting line 1508 is an elastic resistance band. By passing through the device and around the user's leg, its available length and thus also its range of resistance is increased considerably. Elastic resistance bands 1508 offer linear variable resistance, which can be advantageous to users who wish to experience the most resistance near the apex of their exercise motion. In this embodiment the lower heel stay 1514 is a heel strap 1514 which frames the lower edge of the heel socket 1516. Finally, the central pathway 1518 of this embodiment is shown, as an axis passing through the center of area circumscribed by the upper band 1506 at an angle perpendicular to the upper band plane. As shown, this embodiment (as well as others) includes clearance along the central pathway 1518 for insertion and engagement of the lower extremity for proper loading and use.

Special Adaptations

Figure 16:
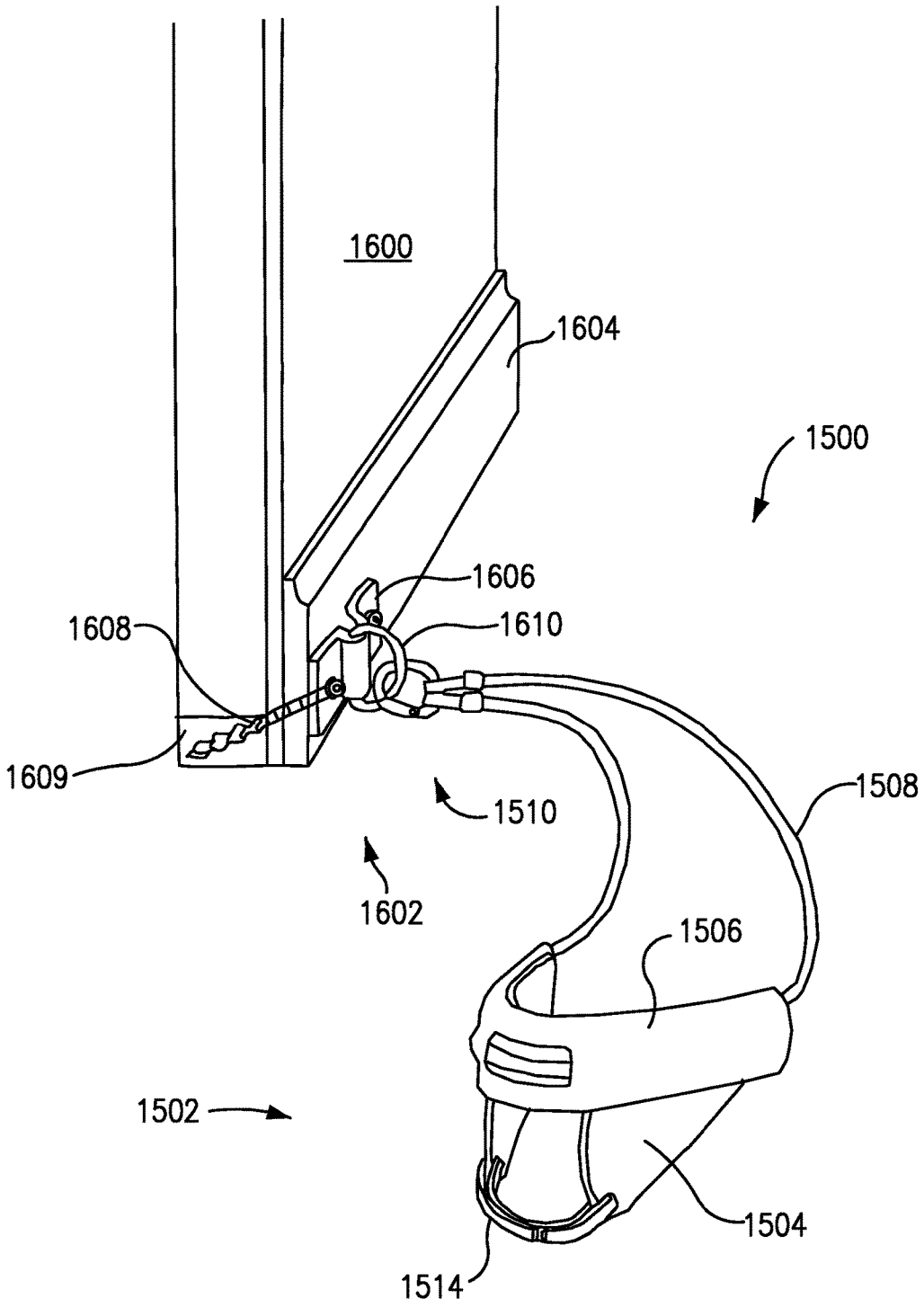
FIGS. 16-19 show special adaptations of the invention for use, specifically.
Figure 17:
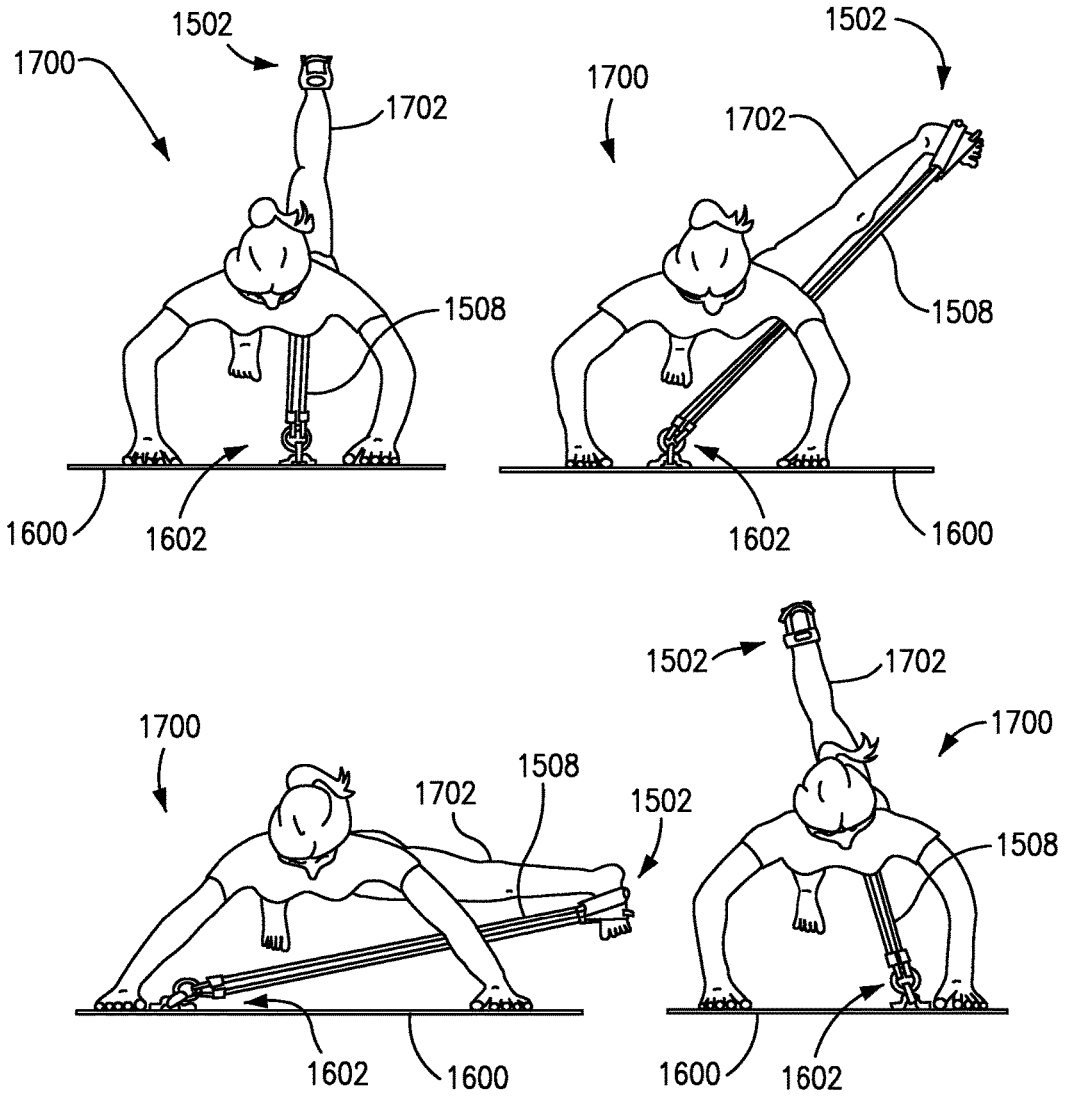
Figure 18:
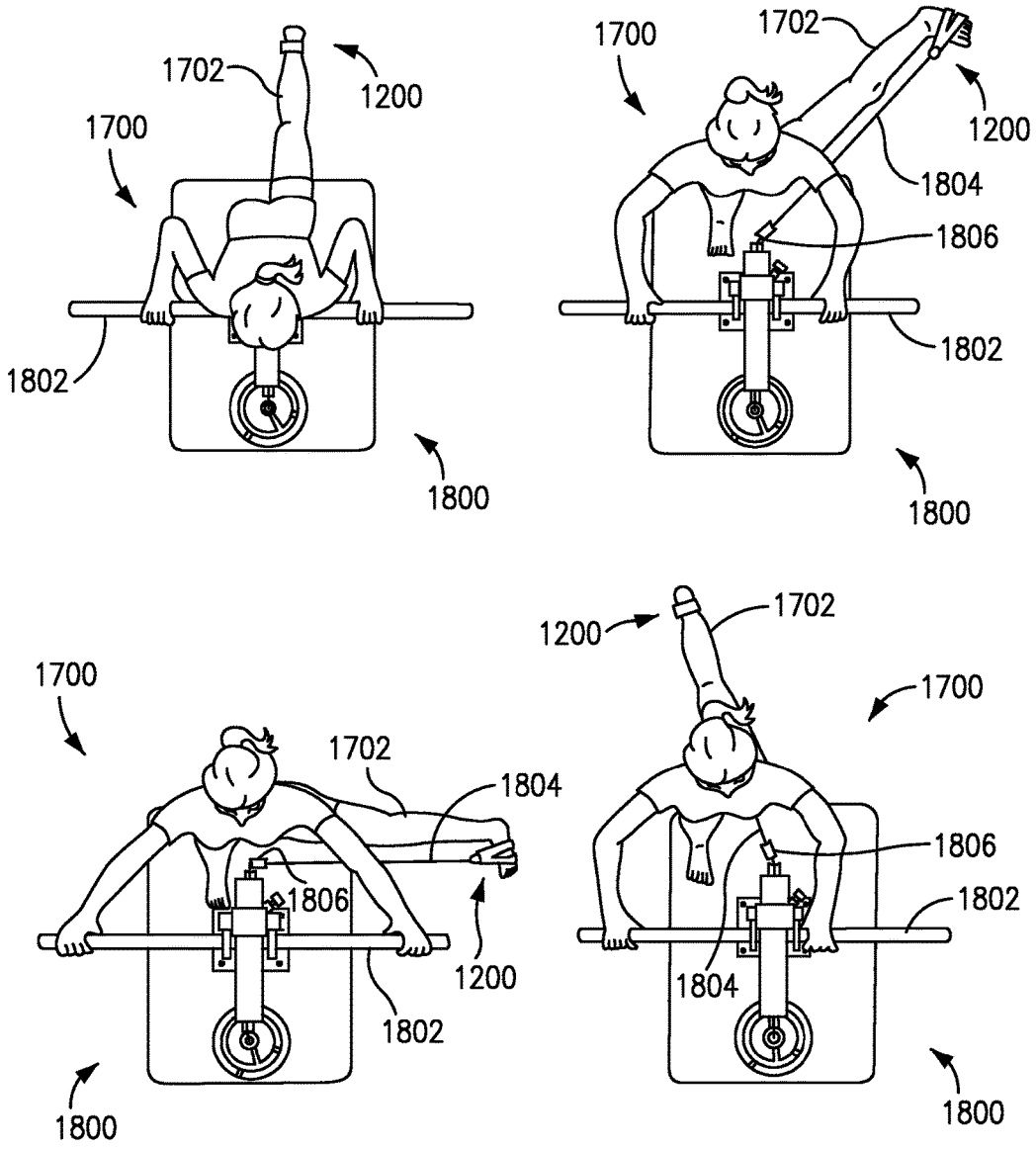

FIGS. 16-19 show special adaptations of embodiments of the invention, specifically: FIG. 16 shows the embodiment of FIG. 15 attached to the foot of a wall via a wall mount; FIG. 17 shows the embodiment of FIG. 15 being used in conjunction with the wall's surface to perform various hip exercises; and FIG. 18 shows the embodiment of FIG. 13 being used with a lower body fitness apparatus to perform various hip exercises.

16

FIG. 16 is an oblique perspective view of the embodiment 1500 of FIG. 15 attached to the foot of a wall 1600 via a dedicated wall mount configuration 1602. The wall mount assembly 1602 shown here, well-known to the truck tiedown art, it is capable of mounting to the bottom trim 1604 of the wall 1600. The wall mount assembly includes a mounting plate 1606 attached to the wall trim 1604 via screws 1608. The screws 1608 can be driven through the trim at such an angle that they are embedded into the bottom plate 1609 of the wall 1600. As the bottom border of a wall's frame, the bottom plate 1609 serves as a reliable anchor for such a wall mount assembly 1602.

Attached to the mounting plate 1606 is a D-ring 1610 that is capable of being swiveled horizontally about its vertical axis (serving as a "swivel axis"). The locking gate 1510 of the embodiment of the device shown here 1502 can be interlocked with the D-ring 1610. The D-ring 1610 is capable of serving as a line-swiveling assembly for the resistance-transmitting line 1508 to be swiveled about the swivel axis. In this way the line 1508 is made available for all leg motion exercise from substantial hip extension to substantial hip abduction of either leg.

17

FIG. 17 is a top view of the embodiment of FIG. 15 being used in conjunction with the wall's surface to perform various hip exercises. The resistance-transmitting line 1508 is an elastic resistance band, which is twice the length of the foot's distance from the wall mount 1602. This greater length makes for a smoother transition in linear variable resistance during exercise. The lower extremity receiving device 1502 shown here is specially designed to enable the elastic line 1508 to wrap around the user's lower extremity and provide linear variable resistance for all of types of exercises shown.

Often, it is advantageous for the line-swiveling assembly 1602 to be located at or near the user's standing leg, with their grip out in front of the swivel 1602. This promotes full range of motion of the exercising leg 1702, with the line and its force vector running parallel to the exercising leg 1702. It also promotes tripod posture, whereby the user's arms and standing leg are spread out like a tripod. Such an arrangement enables both parallel force and tripod posture for all exercises when performed from a single standing position, but this arrangement is not possible when the swivel 1602 is attached to the wall 1600.

However, both parallel force and tripod posture can largely be replicated with the wall mount 1602, despite its not being located in direct proximity to the standing leg. In the case of each of the following exercises shown in FIG. 17, the user 1700 is able to stand in a strategic position so as to largely replicate tripod posture, and enable the force vector of resistance to remain parallel to their exercising leg 1702. This is accomplished in a manner that is unique to each type of exercise, with the user often changing their standing position for different exercises—but in each case, it is nonetheless achievable.

In FIG. 17A, a user 1700 leans into the wall 1600 and extends the hip of their exercising leg 1702, thereby working their gluteus maximus: the largest gluteal muscle. In this exercise, the user 1700 is able to replicate parallel force and tripod posture by standing back from the wall 1600. In so doing, the user creates a space between their standing leg and the wall 1600, which they can span with their arms to create a tripod posture, and lean forward as appropriate. Further, the user's exercising leg 1702 remains aligned towards the swivel 1602, thereby ensuring that the force of resistance remains parallel to the leg.

In FIG. 17B the lower extremity receiving device 1502 is being used with the wall mount 1602 to perform simultaneous hip extension and abduction; specifically, half extension and half abduction. As can be seen, the open design of the sling 1502 induces the user 1700 to rotate their hip external (specifically enlisting the upper gluteus maximus fibers). The exercising leg is brought 45 degrees laterally from the Sagittal plane. Because this movement follows the orientation of the gluteus maximus fibers (and thereby also avoids contraction of the hamstrings), it complete engages the gluteus maximus—indeed, even more so than with straight hip extension. As can be seen, the open design of the sling 1502 promotes and even induces the user 1700 to rotate their hip externally.

Here, the user 1700 accomplishes parallel force and tripod posture by not only standing back from the wall 1600, but shifting their position in the direction of lateral movement of the exercising leg 1702 (in this case, to the user's left, or the viewer's right). This separates their torso from the wall, inducing arm extension and thus tripod posture; while also aligning their exercising leg 1702 with the swivel assembly 1602—thereby providing uniform loading during exercise, as the force vector remains parallel to their exercising leg 1702. In this exercise, the user 1700 is well advised to spread their arms sufficiently wide to counter the torque that is generated about the torso, by the lateral thrust of the leg.

In FIG. 17C the lower extremity receiving device 1502 is being used with the wall mount 1602 to perform straight hip abduction, enlisting the gluteus medius and gluteus minimus. In this instance, the user 1700 has moved even further in the lateral direction of movement of their exercising leg 1702, due to the sharper angle at which the elastic line 1508 is pulled, in relation to the wall 1602. The user 1700 must spread their arms substantially wide, to counter the substantial torque generated by the motion of their exercising leg 1702. Absent any gripping device, the user 1700 may be compelled to lean in on the arm of the same side as the exercising leg 1502 (here, their left arm), and/or lean closer to the swivel assembly 1602—to help orient their body to counter the torque most efficiently.

In FIG. 17D the lower extremity receiving device 1502 is being used with the wall mount 1602 to perform hip adduction. In this instance, the user 1700 can position their standing leg in a similar location relative to the swivel, as in hip extension shown in FIG. 17A. However, the user 1700 may wish to shift their position slightly further lateral to the swivel 1602 (to their right, or the viewer's left). This enables them to once again align their exercising leg 1702 with the swivel 1602, so that the force vector of resistance remains in line with the leg.

Again they can stand back, to effect tripod posture and lean as appropriate. These motions do not enhance gluteal development, but do enhance hip and core strength.

18

FIG. 18 is a top view of the embodiment of FIG. 12 being used with a lower body fitness apparatus 1800 to perform various hip exercises. In this instance, a bar 1802 is available for gripping and exercise is performed using a weight machine cable 1804. Furthermore, the swivel is a pulley 1806 that is not tethered to a wall, and the user 1800 is induced to stand at or near the pulley 1806, to lean over it to reach for a gripping bar 1802. While lacking the minimalist design of a wall mount, this system does provide a more ergonomic arrangement of elements that truly promotes the most ideal tripod posture of all.

In the top-left example of pure hip extension, for instance, the user 1700 is induced to lean forward to counter the force of their extended leg 1702—even farther forward than their grip 1802 is located—which is not possible in the case of the wall mount. In the top-right example of simultaneous hip extension and hip abduction, the user 1700 is able to grasp the bar to help them counter torque with a far more sturdy tripod posture than would be afforded by a wall surface. Likewise in the bottom-left example of pure hip abduction, where the torque can be highly destabilizing, the user 1800 can again avail themselves of the firm grip afforded by the bar 1802. Finally in the bottom-right example of hip adduction, once again it can be seen that torque is better countered by gripping the bar 1802.

19

Figure 19:
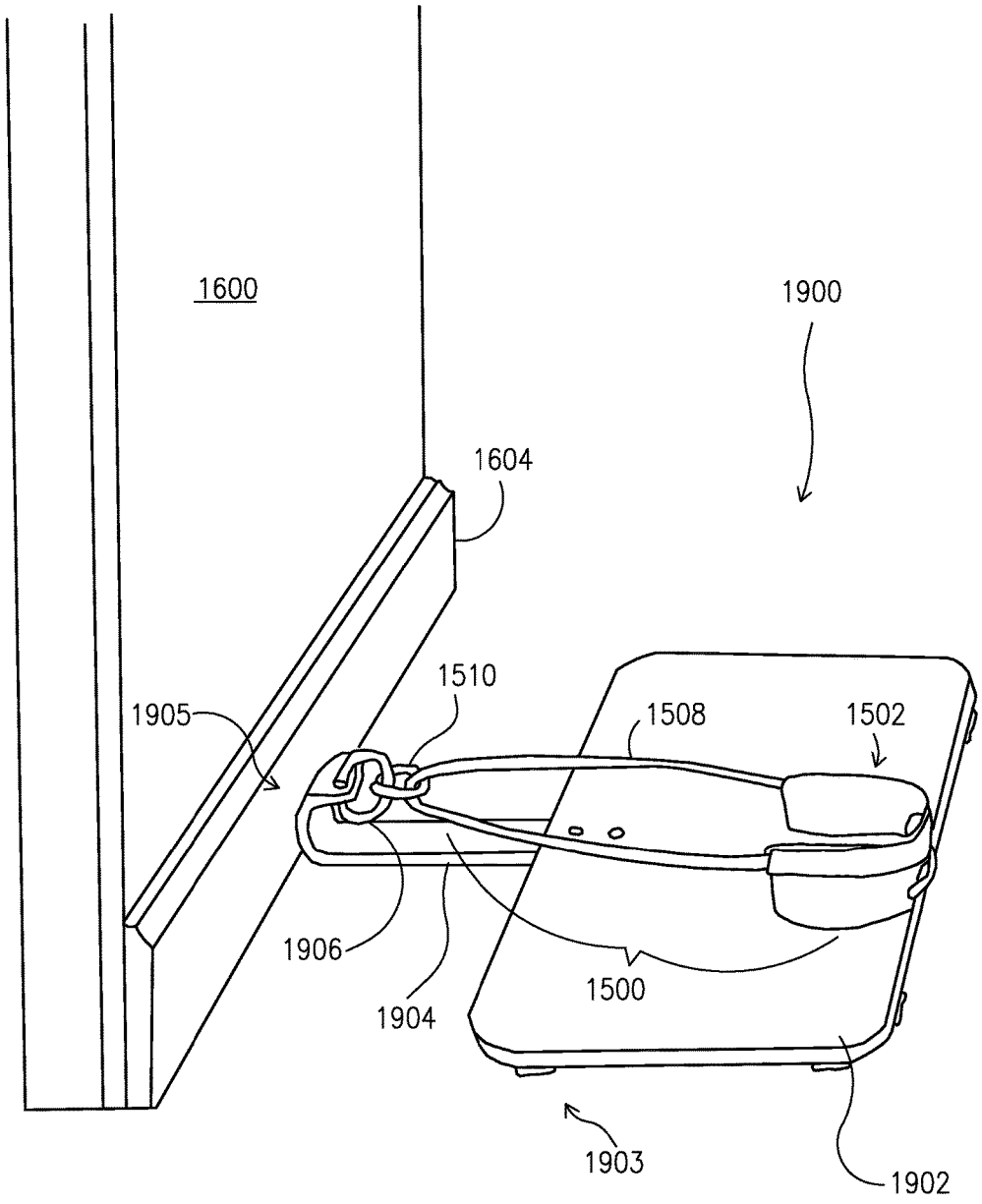

FIG. 19 is a side oblique view of the embodiment 1500 of FIG. 15 set up for use with a portable platform anchor 1900. The platform anchor provides an alternative approach to the wall mount 1602 of FIG. 16, while still enabling the same basic exercise objectives of the wall mount regarding use of the LERD 1500 while leaning against a wall 1600. Like the wall mount 1600, the platform anchor 1900 provides an anchored swiveling assembly; but unlike the wall mount 1600, the platform anchor 1900 does not require installation of any kind, relying instead on the user's weight for stabilization.

The platform anchor 1900 includes a stand-on base 1902 supported by friction feet 1903, and an anchor arm 1904 including a neck 1905 that supports a swiveling ring 1906. The stand-on base 1902 is capable of being stabilized by a user's body weight, in conjunction with the friction feet 1903—which have a surface material such as rubber that promotes friction and gripping of the floor. The anchor arm 1904 and neck 1905 support the swiveling ring 1906 which is anchored firmly in place, due to the firm stabilization of the stand-on base 1602 itself, during use.

The platform anchor 1900 can be an attractive alternative to the wall mount 1602 for a certain demographic of LERD 1500 users. While the wall mount 1602 can be sold inexpensively, it nonetheless requires some handiness on the part of either the user, or someone else on their behalf, for its proper installation through the bottom trim 1604 and into the baseboard of the wall 1600. Furthermore, its installation will negatively impact the wall's aesthetics, and its use will then be restricted to that single location.

By contrast, the platform anchor 1900 does not require any labor of installation and does not negatively impact the wall in any way. This can be a notable attraction for women, who make up a sizable portion of the market, and who may wish to avoid having to install equipment and/or disturb the walls of their home. Furthermore, inasmuch as it is both lightweight and portable, the platform anchor 1900 can easily be transported to any location and used against any wall surface of the user's choosing. This freedom alone can expand the scope of use of the LERD by a significant order of magnitude.

The platform anchor 1900 can be designed to afford a user the same general benefits for exercise, as are available in the case of the wall mount 1600. When placed in the position shown in FIG. 19 with the neck 1905 abutting the wall trim 1604, the swivel assembly 1906 for the LERD is anchored against the wall 1600, and can be held firmly in that position by the user's body weight during use. This position can be ideal for leg exercise involving full or even partial hip extension.

A user can thus use the platform anchor 1900 in the position as shown, to accomplish either pure hip extension, or a combination of substantial hip extension with hip abduction, such as the "45" (half extension, half abduction). The extended length of the anchor arm 1904 enables the elastic band 1508 to be stretched to maximum capacity, while the user is able to stand back from the wall and thus lean forward during hip extension. Leaning forward enables the user to execute full range of hip extension, while also stabilizing their torso as a counterweight to the torque of the exercising leg.

When a user wishes to perform pure hip abduction or a combination of substantial hip abduction along with hip extension, they may rotate the platform anchor 1900 90°, such that the anchor arm 1904 is running parallel to the wall 1600, rather than perpendicular as in FIG. 19. When the user abducts the leg opposite the anchor arm 1904, the elastic band 1508 will once again span a large enough distance as to stretch itself to maximal capacity during full range of abduction. To abduct their other leg, the user can rotate the platform anchor 180° from its first abduction position, so the anchor arm 1904 is then positioned in a second abduction position, opposite that other leg.

The anchor arm 1904 can be length-adjustable. For gluteal muscle exercise involving hip extension and/or hip abduction leg motions, the anchor arm 1904 is most advantageous in the extended position, to ensure that the swivel assembly 1906 is anchored at a sufficient horizontal distance from the user's exercising leg—thus inducing maximal stretching capacity of the elastic band 1508. However, the elastic band can also be used for arm and shoulder work, if attached to an exercise bar for example. In such cases, retracting the anchor arm 1904 to reposition the anchor position closer to the user's feet may be ideal.

The platform anchor may assume a variety of possible design embodiments. For example, in some embodiments, the stand-on base 1902 can simply extend further so as to directly support an extended anchor point, rather than requiring a separate anchor arm 1904 element for anchor support, and the neck can be a simple L-bracket screwed to the underside of the base. Ideally, the platform anchor is made from durable but lightweight materials, such as plywood for the stand-on base and metal for the anchor arm 1904; and a D-ring can be used as the swivel assembly 1906.

The device disclosed in this present application combines key elements in a uniquely advantageous arrangement to accomplish a specific function. Its structure enables full range of motion of an exercising leg for any combination of hip extension and hip abduction, under resistance. Other modifications and implementations of the invention will occur to one of ordinary skilled in the art, without departing from the spirit and the scope of the invention. Thus, the above description is not intended to limit the invention except as indicated in the following claims.

What is claimed is:

1. A lower extremity receiving device for hands-free lower body exercise, the device comprising:

A. a self-standing concave sling configured to securely wrap a portion of a user's lower extremity during exercise, the sling including i. a semi-rigid supportive scaffold adapted to provide structural support to the sling to stand it up and open, thereby enabling the user to engage and disengage the sling for exercise with either leg without using the user's hands, the scaffold having a. a rear wall shaped in a concave locus and framing at least an upper portion of a heel socket, b. a pair of sidewalls, one sidewall extending from each side of the rear wall, the sidewalls lifting the socket above a lower scaffold edge and lending support to stabilize the sling in both upright and side-lying exercise-ready positions, c. the rear wall and the sidewalls include an upper band along an upper portion of the scaffold, a pathway of the upper band lying in an upper band plane, the upper band adapted to receive and contain a posterior leg portion of the user above their heel apex throughout full range of hip extension exercise, when the sling is oriented in the upright exercise-ready position, and receive and contain a lateral mid-foot portion of the user throughout full range of hip abduction exercise, when the sling is oriented in the side-lying exercise-ready position, and ii. a lower heel stay framing a lower portion of the socket to contain a user's heel during full hip extension, the sling having exercise clearance space separate from the socket for efficient hands-free pedal insertion, engagement and exercise, the clearance space fully encompassing a central pathway that runs through a center of area circumscribed by the upper band at an angle perpendicular to the upper band plane, the clearance space extending bidirectionally along the central pathway to thereby pass through and beyond the sling in its entirety, both above and below the sling, the sling maintaining the clearance space both in its resting state and during use, thereby enabling clearance for proper hands-free foot placement; and B. a resistance harness connected to the sling, the harness being adapted to engage a pullable portion of a resistance-transmitting line, the lower extremity receiving device thereby enabling the user to safely perform full range of exercise motion for any combination of hip extension and hip abduction at maximal muscle engagement under line resistance, via hands-free insertion of either foot into the sling.

2. The lower extremity receiving device of claim 1, wherein the scaffold includes a spring function that induces the sling to expand and assume a semi-rigid open state for receiving the user's foot when not in use, but also allows the sling to wrap securely around the portion of the user's lower extremity during use.

3. The lower extremity receiving device of claim 2, wherein the spring function is provided by a connective element that runs along an outside surface of the upper band, also connecting the harness to the sling.

4. The lower extremity receiving device of claim 1, where the harness includes a tubular enclosure that runs along an outside surface of the upper band and is thereby capable of wrapping around the user's posterior leg above their heel apex.

5. The lower extremity receiving device of claim 4, wherein the enclosure includes at least one of a) a plurality of loops and b) a channel.

6. The lower extremity receiving device of claim 4, wherein the enclosure is capable of supporting and enabling at least one of a) a belt adapted to connect to a weight machine cable or b) an elastic resistance line to pass through its interior space.

7. The lower extremity receiving device of claim 4, wherein the enclosure is adapted to open or close along a lengthwise seam for easy insertion into and removal from its interior space.

8. The lower extremity receiving device of claim 1, wherein the sling is capable of being coupled with a line-swiveling assembly to enable full range of motion of exercise under line resistance.

9. The lower extremity receiving device of claim 8, wherein the line-swiveling assembly is at least one of a) a pulley, or b) an elastic band anchor.

10. The lower extremity receiving device of claim 1, wherein the sling includes a cushioning material.

11. The lower extremity receiving device of claim 1, wherein the lower heel stay is one of:

a lower band included in the scaffold; or a heel strap connected to the scaffold.

12. The lower extremity receiving device of claim 1, wherein the lower heel stay is adjustable, and thus capable of also adjusting a size of the socket.

13. The lower extremity receiving device of claim 1, wherein the socket and the upper band are shaped and positioned relative to each other as to substantially conform laterally about a common columned surface.

14. The lower extremity receiving device of claim 1, wherein the harness is substantially coextensive with the upper band.

15. The lower extremity receiving device of claim 1, wherein the harness includes a top edge that is aligned substantially at an acute angle relative to a bottom edge of the sling, the angle having a vertex located opposite the socket relative to the harness.

16. The lower extremity device of claim 1, wherein the sidewalls include at least one of a) outwardly flared edges, b) concave vertical curvature, or c) a low-friction inner surface, to minimize interference with the user's lower extremity during use and thereby facilitate ideal exercise form.

* * * * *